US011267252B2

(12) United States Patent
Kuri et al.

(10) Patent No.: US 11,267,252 B2
(45) Date of Patent: Mar. 8, 2022

(54) EJECTION APPARATUS AND IMPRINT APPARATUS

(71) Applicant: CANON KABUSHIKI KAISHA, Tokyo (JP)

(72) Inventors: Masahiro Kuri, Utsunomiya (JP); Noriyasu Hasegawa, Utsunomiya (JP); Hisashi Namba, Utsunomiya (JP); Ken Katsuta, Saitama (JP); Keita Sakai, Utsunomiya (JP); Nobuto Kawahara, Utsunomiya (JP); Kenichi Kobayashi, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 16/880,026

(22) Filed: May 21, 2020

(65) Prior Publication Data

US 2020/0376851 A1 Dec. 3, 2020

(30) Foreign Application Priority Data

May 28, 2019 (JP) ..... JP2019-099327
Feb. 21, 2020 (JP) ..... JP2020-028557

(51) Int. Cl.
*B41J 2/175* (2006.01)

(52) U.S. Cl.
CPC ..... *B41J 2/17596* (2013.01)

(58) Field of Classification Search
CPC .... B41J 2/175; B41J 2/17596; B41J 2/17556; B41J 2/17513; B41J 2/17566; B41J 2/17553
See application file for complete search history.

(56) References Cited

U.S. PATENT DOCUMENTS 8,100,500 B2 * 1/2012 Bansyo ..... B41J 2/185 347/19
9,340,032 B2 5/2016 Araki et al.
9,475,303 B2 10/2016 Araki et al.
9,616,673 B2 * 4/2017 Domae ..... B41J 2/18
10,421,283 B2 9/2019 Araki et al.
10,513,125 B2 * 12/2019 Kawahara ..... B41J 2/14233
10,894,416 B2 * 1/2021 Nakai ..... B41J 2/17556

FOREIGN PATENT DOCUMENTS

JP 2015-092549 A 5/2015
WO 2019/107383 A1 6/2019

OTHER PUBLICATIONS

Kawahara et al., U.S. Appl. No. 16/766,384, filed May 22, 2020.
Kawahara et al., U.S. Appl. No. 16/838,254, filed Apr. 2, 2020.

* cited by examiner

*Primary Examiner* — An H Do
(74) *Attorney, Agent, or Firm* — Venable LLP

(57) ABSTRACT

Provided is an ejection apparatus including: an ejection head having an ejection opening for ejecting an ejection material in a liquid state; a storage container storing therein the ejection material and communicating with the ejection head; and a pressure control unit that maintains the pressure inside the storage container at a negative pressure. The pressure control unit generates a first pressure in the storage container in a normal operation, the first pressure being capable of forming a meniscus of the ejection material in the ejection opening. The pressure control unit drops the pressure inside the storage container to at least the first pressure in a case where the pressure inside the storage container reaches a predetermined pressure above the first pressure.

18 Claims, 13 Drawing Sheets

EJECTION APPARATUS AND IMPRINT APPARATUS

BACKGROUND OF THE INVENTION

Field of the Invention

The present disclosure relates to an ejection apparatus that ejects an ejection material in a liquid state from an ejection head, and an imprint apparatus including an ejection apparatus.

Description of the Related Art

In Japanese Patent Laid-Open No. 2015-092549, a configuration including a pressure control unit that controls the pressure inside a storage container is disclosed as an ejection apparatus that ejects a liquid or an ejection material in a liquid state stored in the storage container from the ejection openings in an ejection head.

SUMMARY OF THE INVENTION

The present disclosure provides an ejection apparatus including: an ejection head having an ejection opening for ejecting an ejection material in a liquid state; a storage container storing therein the ejection material and communicating with the ejection head; and a pressure control unit that maintains pressure inside the storage container at a negative pressure. The pressure control unit generates a first pressure in the storage container in a normal operation, the first pressure being capable of forming a meniscus of the ejection material in the ejection opening. The pressure control unit drops the pressure inside the storage container to at least the first pressure in a case where the pressure inside the storage container reaches a predetermined pressure above the first pressure.

Further features of the present invention will become apparent from the following description of exemplary embodiments with reference to the attached drawings.

DESCRIPTION OF THE EMBODIMENTS

The ejection apparatus disclosed in Japanese Patent Laid-Open No. 2015-092549 does not take into consideration a process to handle leakage of the ejection material from the ejection openings. Thus, there is a possibility that a substrate or the inside of the apparatus gets contaminated by the ejection material leaking from the ejection openings.

In view of this, the present disclosure provides an ejection apparatus and an imprint apparatus capable of suppressing contamination by an ejection material leaking from the ejection openings of an ejection head.

Embodiments will be described below with reference to the drawings. Note that the description will be given with the same reference signs given to the same or equivalent components. Also, relative positions, shapes, and the like of the constituent elements described in the embodiments are mere examples.

First Embodiment

In a first embodiment, a description will be given of an imprint apparatus and an ejection apparatus usable in the imprint apparatus.

<Imprint Apparatus>

Figure 1:
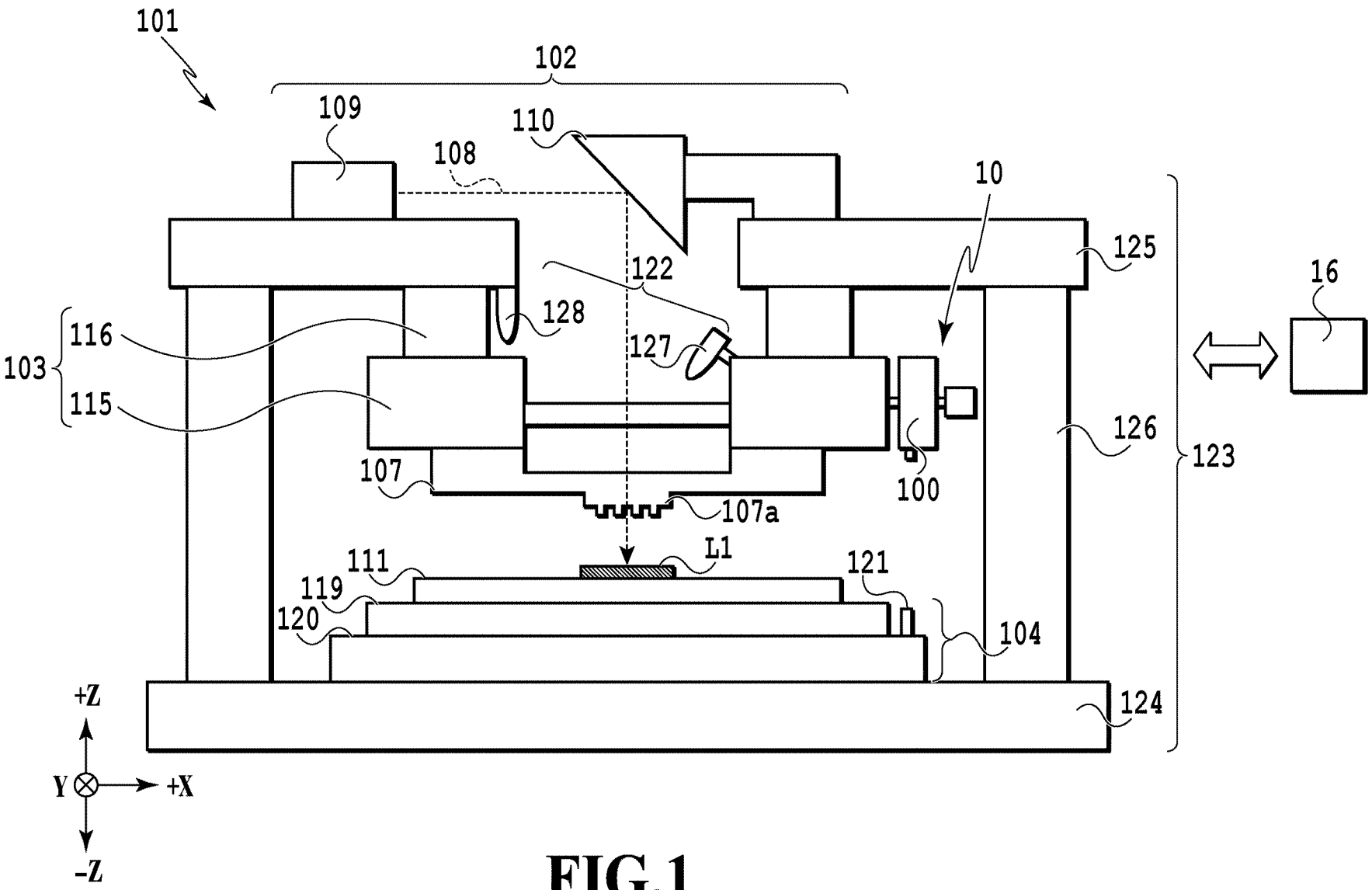
FIG. 1 is a diagram showing a schematic configuration of an imprint apparatus.

FIG. 1 is a diagram showing a schematic configuration of an imprint apparatus 101 usable in the present embodiment. The imprint apparatus 101 is used to manufacture various devices such as semiconductor devices. The imprint apparatus 101 includes an ejection apparatus 10. The ejection apparatus 10 ejects an ejection material L1 (resist) onto a substrate 111. The ejection material L1 is a photo-curable resin having such properties that it cures by receiving an ultraviolet ray 108 or the like. The ejection material L1 is selected as appropriate according to various conditions in a semiconductor device manufacturing process or the like. Instead of a photo-curable material, a thermosetting resist, for example, may be used as the ejection material. Also, the imprint apparatus may be an apparatus that performs an imprint process by curing a resist with heat. In the imprint apparatus, the ejection material L1 is the imprint material.

The imprint apparatus 101 performs an imprint process including the series of processes below. Specifically, with the ejection apparatus 10, the imprint apparatus 101 ejects the ejection material L1 onto the substrate 111. The imprint apparatus 101 then presses a mold 107 having a molding pattern against the ejection material L1 ejected onto the substrate 111 and, in this state, applies light (ultraviolet ray) to cure the ejection material L1. Thereafter, the imprint apparatus 101 separates the mold 107 from the cured ejection material L1. As a result, the molding pattern on the mold 107 is transferred onto the substrate 111.

The imprint apparatus 101 includes a light application unit 102, a mold holding mechanism 103, a substrate stage 104, the ejection apparatus 10, a control unit 16, a measurement unit 122, and a housing 123.

The light application unit 102 has a light source 109 and an optical element 110 that corrects the ultraviolet ray 108 emitted from the light source 109. In an example, the light source 109 is a halogen lamp that generates i- or g-line wavelength light. The ultraviolet ray 108 is applied to the ejection material L1 through the mold (die) 107. The wavelength of the ultraviolet ray 108 is a wavelength suitable for the ejection material L1 to be cured. In a case of an imprint apparatus using a thermosetting resist as the resist, a heat source unit that cures the thermosetting resist is installed in place of the light application unit 102.

The mold holding mechanism 103 has a mold chuck 115 and a mold drive mechanism 116. The mold 107, which is held by the mold holding mechanism 103, has a rectangular outer periphery, and its surface facing the substrate 111 has a pattern portion 107*a* on which a three-dimensional concavo-convex pattern such as a circuit pattern to be transferred is formed. The material of the mold 107 in the present embodiment is a material capable of transmitting the ultraviolet ray 108. In an example, quartz is used.

The mold chuck 115 holds the mold 107 by vacuum suction or with electrostatic force. The mold drive mechanism 116 moves the mold 107 by holding and moving the mold chuck 115. The mold drive mechanism 116 is capable of pressing the mold 107 against the ejection material L1 by moving the mold 107 in a −Z direction (downward). The mold drive mechanism 116 is also capable of separating the mold 107 from the ejection material L1 by moving the mold 107 in a +Z direction (upward). Note that the operation of pressing the mold 107 against the ejection material L1 or the operation of separating the mold 107 from the ejection material L1 may be implemented by moving the substrate stage 104 in the +Z direction or by moving both the mold 107 and the substrate stage 104 relative to each other.

The substrate stage 104 has a substrate chuck 119, a substrate stage housing 120, and a stage reference mark 121, and moves in an X direction and a Y direction. The substrate 111, which is held by the substrate stage, is a monocrystalline silicon substrate or a silicon-on-insulator (SOI) substrate. A pattern of the ejection material L1 ejected from the ejection apparatus 10 (ejection material pattern) is to be formed on a predetermined portion of a processing target surface of the substrate 111.

The substrate chuck 119 holds the substrate 111 by vacuum suction or the like. The substrate stage housing 120 moves the substrate 111 by holding the substrate chuck 119 and moving it in the X direction and the Y direction with a mechanical unit. The stage reference mark 121 is used to set a reference position of the substrate 111 in alignment of the substrate 111 and the mold 107. In an example, a linear motor is used as an actuator for the substrate stage housing 120. Alternatively, the actuator of the substrate stage housing 120 may be configured of a plurality of drive systems a coarse movement drive system and a fine movement drive system.

The ejection apparatus 10 has an ejection cartridge 100 and a later-described pressure control unit that controls the pressure inside a storage container 13 of the ejection cartridge 100. The ejection cartridge 100 includes the storage container 13 (see FIG. 2), which stores the ejection material, and an ejection head 14 (see FIG. 2) which is mounted to the storage container 13. Details of a configuration of the ejection apparatus 10 will be described later.

The measurement unit 122 has an alignment measurement instrument 127 and an observation measurement instrument 128. The alignment measurement instrument 127 measures misalignment between an alignment mark formed on the substrate 111 and an alignment mark formed on the mold 107 in the X direction and the Y direction. The observation measurement instrument 128 is an image capturing apparatus such as a CCD camera, for example, and captures an image of a pattern of the ejection material L1 ejected onto the substrate 111 (ejection material pattern) and outputs it as image information to the control unit 16.

The control unit 16 controls the operations of constituent elements of the imprint apparatus 101 and so on. In an example, the control unit 16 is a computer having a CPU, a ROM, and a RAM. The control unit 16 is connected to constituent elements of the imprint apparatus 101 through lines, and the CPU controls the drive of the constituent elements in accordance with a control program stored in the ROM. The control unit 16 controls the operations of the mold holding mechanism 103, the substrate stage 104, and the ejection apparatus 10 based on measurement information from the measurement unit 122. Note that the control unit 16 may be configured integrally with other parts of the imprint apparatus 101 or may be implemented as a separate apparatus from the imprint apparatus 101. Also, the control unit 16 may be configured of a plurality of computers, instead of a single computer.

The housing 123 includes a base surface plate 124 on which the substrate stage 104 is placed, a bridge surface plate 125 to which the mold holding mechanism 103 is fixed, and columns 126 which are provided upright on the base surface plate 124 and support the bridge surface plate 125. The imprint apparatus 101 further includes a mold conveyance mechanism (not shown) that conveys the mold 107 from outside the apparatus to the mold holding mechanism 103, and a substrate conveyance mechanism (not shown) that conveys the substrate 111 from outside the apparatus to the substrate stage 104.

<Configuration of Ejection Apparatus>

Figure 2:
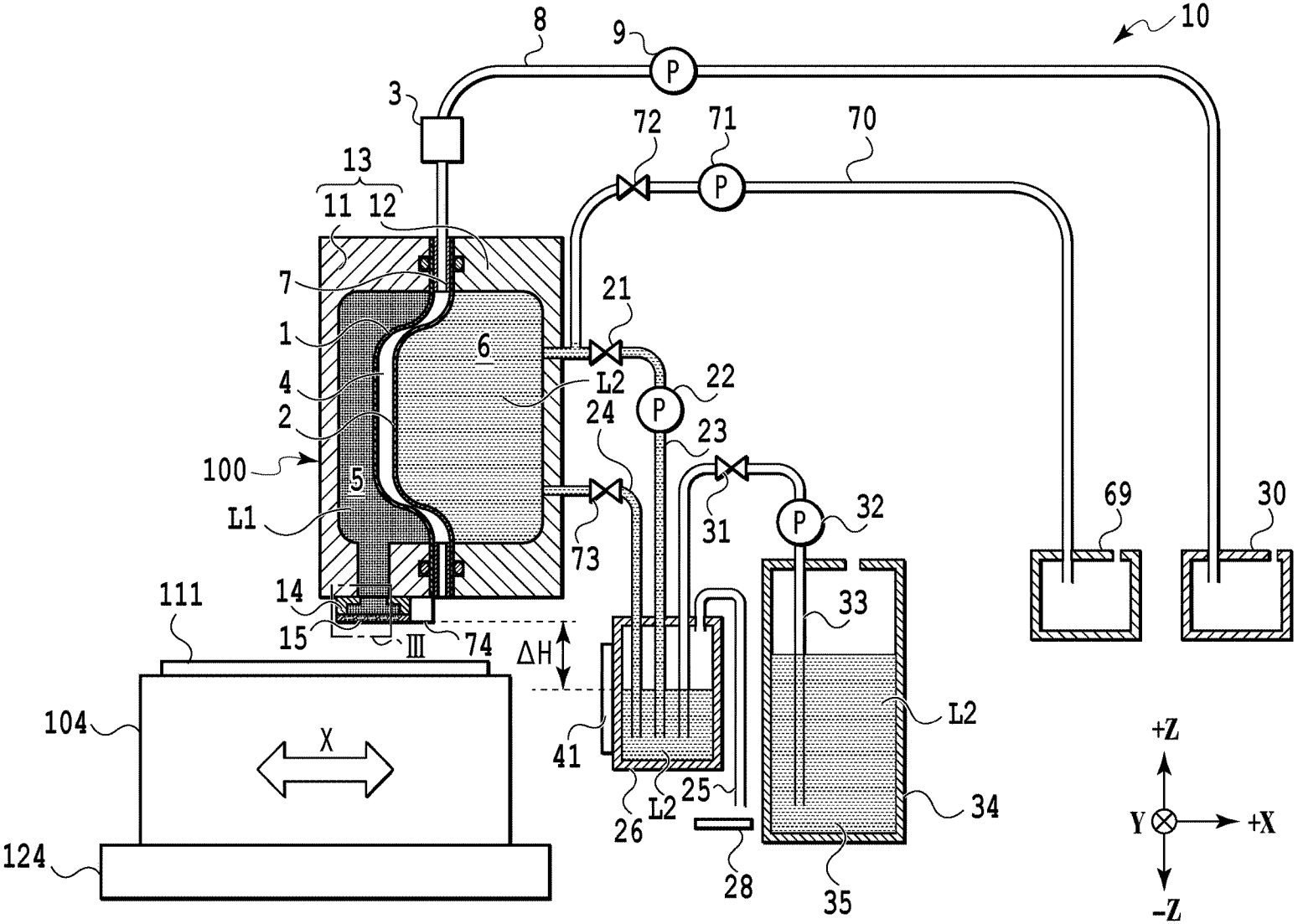
FIG. 2 is a diagram showing a configuration of an ejection apparatus in a first embodiment.

FIG. 2 is a diagram showing a configuration of the ejection apparatus 10 provided in the imprint apparatus 101. The ejection apparatus 10 has the ejection cartridge 100 and the pressure control unit that controls the internal pressure of the ejection cartridge 100. The ejection cartridge 100 includes a storage container 13 having a housing 11 and a housing 12, and the ejection head 14.

The housing 11 and the housing 12 form the outer shell of the storage container 13. Opening portions are formed in the housing 11 and the housing 12 at positions facing each other. The opening portion in the housing 11 is sealed by a film 1, so that a first liquid chamber 5 is formed. The ejection material L1 in a liquid state to be ejected onto the substrate 111 is filled in the first liquid chamber 5. Also, the first liquid chamber 5 communicates with the outside space through the ejection head 14.

The opening portion in the housing 12 is sealed by a film 2, so that a second liquid chamber 6 is formed. An operating fluid L2 is filled in the second liquid chamber 6. The second liquid chamber 6 is coupled to a sub tank (storage unit) 26 included in the pressure control unit through a supply pipe 23 and a communication pipe 24. The operating fluid is a substance whose change in density (volume) as a result of being exposed to external temperature and pressure is negligibly small as compared to that of gas. Thus, the volume of the operating fluid 3 hardly changes even in a case where the temperature or pressure of the air around the ejection apparatus 10 changes. In an example, a substance selected from water-like liquids and gel-like substances can be used as the operating fluid 3. The difference between the density of the ejection material and the density of the operating fluid is usually smaller than the difference between the density of the ejection material and the density of gas.

As described above, the internal space of the storage container 13 is divided into the first liquid chamber 5 and the second liquid chamber 6 by the film 1 and the film 2, which form a flexible partition. Additionally, annular inter-film plates 7 are provided as spacers between edge portions of the film 1 and edge portions of the film 2, and an inter-film space 4 through which liquid and air can flow is formed between the film 1 and the film 2 by these plates. The film 1 and the film 2 are thin films having a thickness of 10 to 100 micrometers. The materials of the film 1 and the film 2 only need to be materials that have flexibility and also resistance to the ejection material and the operating fluid. In an example, a material such as polytetrafluoroethylene (PTFE) can be used. Meanwhile, although the two films 1 and 2 are used in the present embodiment, a single flexible film can be used as a flexible partition to divide the internal space of the storage container.

Figure 3:
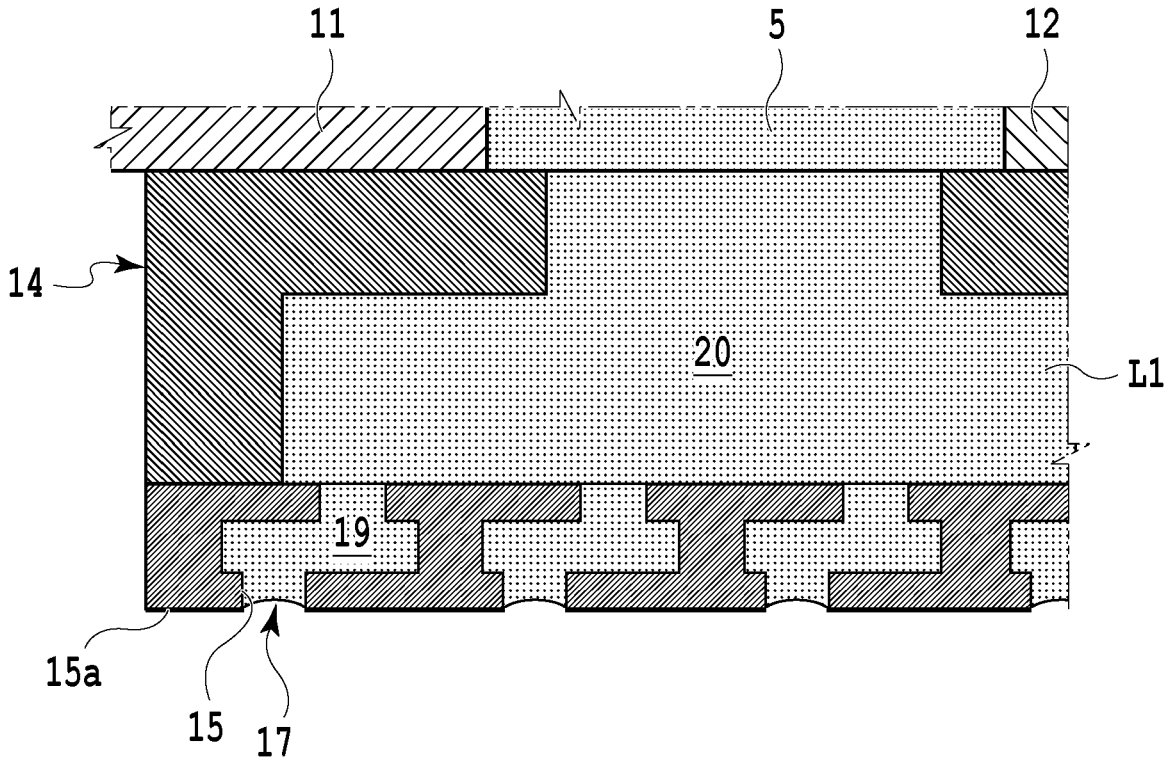
FIG. 3 is a partial enlarged view of ejection openings in an ejection head and their surroundings.

The ejection head 14, on the other hand, is provided on the bottom of the above-described storage container 13, and communicates with the first liquid chamber 5. FIG. 3 shows a partial enlarged cross section of ejection openings 15 in the ejection head 14 and their surroundings. In the ejection head 14, the ejection openings 15 are formed at a density of 500 to 1000 ejection openings per inch. An ejection mechanism (not shown) is installed in each of pressure chambers 19 individually provided for the ejection openings 15. The ejection mechanism is, for example, a piezoelectric element or heat generation element (not shown) or the like. By applying energy such as pressure, vibration, or heat to the ejection material L1 supplied in the pressure chamber 19, the ejection mechanism is capable of ejecting the ejection material L1 from the ejection opening 15. The ejection mechanism only needs to be capable of generating such energy as to eject the ejection material L1 in the form of a minute droplet, e.g., a 1 pL-droplet or the like.

Each pressure chamber 19 communicates with a common liquid chamber 20, and this common liquid chamber 20 communicates with the first liquid chamber 5 in the storage container 13. The ejection material L1 to be ejected from the ejection openings 15 is supplied to the pressure chambers 19 from the storage container 13 through the common liquid chamber 20. The ejection head 14 does not have a control valve between itself and the first liquid chamber 5 for controlling the flow of the ejection material L1. For this reason, the pressure inside the storage container 13 is controlled to be a lower pressure (negative pressure) than the air pressure outside the ejection openings 15 (atmospheric pressure). As a result of this negative pressure control, the ejection material in each ejection opening 15 forms a meniscus 17 at the lowermost end of the ejection opening 15 (near the opening portion of the ejection opening 15) and is thus in a suitable state for ejection. This enables suppression of leakage (drippage) of the ejection material L1 from the ejection openings 15 at an unexpected timing. In the present embodiment, the internal pressure of the storage container 13 is controlled to be a pressure lower than the atmospheric pressure by 0.3 to 0.5 kPa (negative pressure). Note that the ejection head 14 is disposed at such a position that the distance between an ejection opening surface 15*a* at which the opening portions of the ejection openings 15 are formed and the substrate 111, which is the ejection target object, in the vertical direction is 500 um or less.

With the above configuration, in a case where a difference in internal pressure is generated between the first liquid chamber 5 and the second liquid chamber 6, the film 1 and the film 2, which are flexible, both move toward the side with the lower pressure and stop moving at the point where the internal pressure difference disappears. This movement is repeated each time an internal pressure difference is generated. This enables the first liquid chamber 5 and the second liquid chamber 6 to be constantly maintained in a state of being equal in internal pressure.

A more specific description will now be given. As the ejection material L1 is ejected from the ejection head 14, the capacity of the inside of the first liquid chamber 5 decreases, and the internal pressure of the first liquid chamber 5 drops by an amount corresponding to the decreased capacity. If the film 2 does not move at this time, the capacity of the inside of the second liquid chamber 6 does not change, so that the internal pressure of the second liquid chamber 6 becomes higher than the internal pressure of the first liquid chamber 5. In the present embodiment, however, the film 1 and the film 2 are both flexible. Thus, as the capacity of the first liquid chamber 5 decreases, the film 2 moves toward the first liquid chamber 5 along with the film 1 by an amount corresponding to the decreased capacity. Simultaneously with this, the operating fluid L2 is sucked in from the sub tank 26 into the second liquid chamber 6 through the communication pipe 24. As a result, the internal pressures of the first liquid chamber 5 and the second liquid chamber 6 become equal again and reach equilibrium. Note that in the present embodiment, the film 1 and the film 2 are partially coupled to each other by welding or the like for smooth simultaneous movement of the film 1 and the film 2.

Also, while a polytetrafluoroethylene-based material can be used for the film 1 and the film 2, as mentioned above, they can be made from other materials. The hardness of a polytetrafluoroethylene-based film is high, and it is also technically difficult to form it into a thin shape. In view of this, a material that has resistance to the ejection material L1, such as PTFE, may be used for the film 1 while a material that has resistance to the operating fluid L2, e.g., a nylon-based soft material, may be used for the film 2. Further, the film 1 may be formed thin, and a film 2 thicker than the film 1 may be used. By using films made of different materials and/or having different thicknesses as the two films 1 and 2 as described above, the rigidity of the films as a whole is lowered. Accordingly, the movement of the film 1 and the film 2 in response to ejection of the ejection material L1 is rendered smoother. Besides the above, the thickness of the film 1 may be made greater than the thickness of the film 2 to protect the ejection material L1. Doing this enables smooth movement of the film 1 and the film 2 while also providing more reliable protection of the ejection material L1.

Next, the pressure control unit that controls the internal pressure of the storage container 13 will be described. The pressure control unit includes the sub tank 26, the communication pipe 24, the supply pipe 23, first to fourth control valves 73, 21, 72, and 31, liquid feed pumps 22 and 32, a main tank 34, a first discharge pipe 70, a first discharge pump (negative pressure generation unit) 71, and so on. The sub tank 26 is configured to be capable of storing the operating fluid L2, and is connected to the second liquid chamber 6 through the communication pipe 24 and the supply pipe 23. At an intermediate portion of the communication pipe 24, the first control valve (first valve) 73 is provided, which is capable of opening and closing and switches between enabling and blocking communication between the second liquid chamber 6 and the sub tank 26.

The supply pipe 23 is provided with the liquid feed pump 22 and also with the control valve 21, which is capable of opening and closing and switches between enabling and blocking communication between the liquid feed pump 22 and the second liquid chamber. Also, one end of the first discharge pipe 70 is coupled to a portion of the supply pipe 23 between the second control valve 21 and the second liquid chamber 6. The other end of the first discharge pipe 70 is coupled to a first waste liquid container 69. The first discharge pipe 70 is provided with the first discharge pump 71 and the third control valve (second valve) 72. The third control valve 72 is a valve which is capable of opening and closing and switches between enabling and blocking communication between the supply pipe 23 and the first discharge pump 71. The control unit 16 (FIG. 1) controls the drive of the first to fourth control valves 73, 21, 72, and 31, the liquid feed pumps 22 and 32, the first and second discharge pumps 9 and 71, and so on in the pressure control unit in the present embodiment.

In the present embodiment, a first pressure control unit that generates a negative pressure (first pressure) in the storage container 13 for forming a meniscus suitable for ejection in each ejection opening 15 includes the sub tank 26, the communication pipe 24, and the first control valve (first valve) 73. Also, a second pressure control unit that generates a pressure (second pressure) lower than the first pressure in the storage container 13 includes the first discharge pump 71, the first discharge pipe 70, the third control valve (second valve) 72.

The ejection apparatus 10 is also provided with a breakage detection mechanism (breakage detection unit) that, in a case where a portion of the above-described film 1 or film 2 provided in the storage container 13 is broken and the ejection material L1 or the operating fluid L2 leaks from this broken portion into the inter-film space 4, detects this breakage and leakage. The breakage detection mechanism includes a second discharge pipe 8 coupled at one end to the inter-film space 4 in the storage container 13, the second discharge pump 9 and a leakage sensor 3 provided to the second discharge pipe 8, and a second waste liquid container 30.

While the ejection apparatus 10 is performing an ejection operation, the second discharge pump 9 is constantly in operation to suck in the air in the inter-film space 4. Thus, in a case where the film 1 or the film 2 gets broken and the ejection material L1 or the operating fluid L2 leaks into the inter-film space 4, the leaking liquid is sucked into the second discharge pipe 8. The leakage sensor 3 is capable of detecting both the ejection material L1 and the operating fluid L2 thus sucked in, which enables detection of breakage of the film 1 and the film 2. Note that the operations of the ejection apparatus 10 and the imprint apparatus 101 are stopped in a case where breakage of the film 1 or 2 is detected.

The ejection apparatus 10 is also provided with a camera 74 that captures an image of the upper surface of the substrate 111. With this camera 74, it is possible to identify the position of the ejection material L1 applied onto the substrate 111 and to check the state of the ejection material L1. It is also possible to detect an ejection opening(s) 15 from which the ejection material L1 has leaked based on an image captured by the camera 74. The ejection apparatus 10 is further provided with a full-level sensor 28 that detects that the operating fluid L2 supplied into the sub tank 26 has exceeded the storage capacity of the sub tank 26 and leaked out through an air intake pipe 25. Also, the sub tank 26 is provided with a liquid level sensor 41 that detects the position of the liquid surface of the operating fluid L2 stored inside the sub tank 26. Note that the CPU of the control unit 16 controls the drive of components based on output results from the liquid level sensor 41, the full-level sensor 28, the leakage sensor 3, the camera 74, and so on.

<Operation of Ejection Apparatus>

In the ejection apparatus 10 with the above configuration, the sub tank 26 communicates with the atmosphere through the air intake pipe 25, which is an atmosphere communication pipe, as shown in FIG. 2, and therefore the internal pressure of the sub tank 26 is equal to the atmosphere pressure. In a normal operation, in which leakage of the ejection material L1 from the ejection openings 15 is not detected, the first control valve 73 is in an open state. Thus, the operating fluid L2 is filled in the communication pipe 24, through which the sub tank 26 and the second liquid chamber 6 communicate with each other, and the operating fluid L2 is stored in the sub tank 26.

The liquid surface position of the operating fluid L2 in the vertical direction (hereinafter also referred to as "liquid surface level") inside the sub tank 26 is set at a position lower than the ejection openings 15 of the ejection head 14 by ΔH. This value of ΔH (hydraulic head difference) is set so as to maintain the meniscus 17 of the ejection material L1 at a position suitable for ejection inside each ejection opening. Specifically, the value of the hydraulic head difference ΔH is set so as to prevent the ejection material L1 from leaking or dripping to the outside from the ejection openings 15 or to prevent the meniscus 17 from being excessively pulled in toward the back side (e.g., to near the common liquid chamber). More specifically, the value of the hydraulic head difference ΔH is set at 40±4 mm so that the internal pressure of the second liquid chamber 6 can be lower than the atmospheric pressure by 0.40±0.04 kPa. Note that the above value is an example. The value of the hydraulic head difference ΔH needs to be set as appropriate according to the diameter of the ejection openings 15 and physical properties of the ejection material (e.g., density, viscosity, and so on).

The ejection apparatus 10 in the present embodiment is assumed to be an ejection apparatus to be used in an imprint apparatus capable of ejecting a liquid amount of about 1 picoliter (pL) or less from each ejection opening 15 of the ejection head 14 in a single ejection operation. The ejection material L1 is an imprint material and has a density substantially equal to that of water. Also, the diameter of the ejection openings 15 is about 10 micrometers (μm). In light of these conditions, the value of the hydraulic head difference ΔH is set at 40 mm±4 mm.

Here, some ejection heads have an ejection opening diameter of about several tens of μm and thus have a low resolution, and there are ejection materials with various physical properties. Thus, the numerical value of the hydraulic head difference ΔH needs to be changed according to the apparatus in which the ejection apparatus is to be used.

In a case where the level of the liquid surface detected by the liquid level sensor 41, which is provided on a side surface of the sub tank 26, exceeds the range of ±4 mm from a reference liquid surface level (the level 40 mm below the ejection openings 15), a sequence to correct the operating fluid L2 inside the sub tank 26 is performed. For example, as the ejection apparatus 10 performs an ejection operation and thus consumes the ejection material L1 in the ejection cartridge 100, the operating fluid L2 in the sub tank 26 is pumped in an amount corresponding to the consumed volume, so that the liquid surface inside the sub tank 26 lowers. As the liquid surface inside the sub tank 26 lowers, the hydraulic head difference ΔH increases. Here, in a case where the hydraulic head difference ΔH increases excessively, the negative pressure in the storage container 13 increases excessively, which leads to a possibility of sucking in the outside air from the ejection openings 15.

Thus, in the ejection apparatus 10 shown in FIG. 2, the liquid surface inside the sub tank 26 is measured with the liquid level sensor 41, which is provided on a side surface of the sub tank 26, and a sequence to supply the operating fluid L2 into the sub tank 26 is performed in a case where the liquid surface lowers beyond a predetermined range (4 mm in the present case). Specifically, the liquid feed pump 32 and the fourth control valve 31 are driven to supply the operating fluid L2 from the main tank 34 to the sub tank 26. On the other hand, in a case where the liquid surface inside the sub tank 26 rises beyond the predetermined range, the operating fluid L2 is returned from the sub tank 26 to the main tank 34. In this manner, the liquid surface inside the sub tank 26 is controlled to be within the desired range (which is what is called "liquid surface adjustment function").

Further, in a normal operation, in which no leakage (liquid leakage) is detected, the liquid feed pump 22 is operated with the third control valve 72 closed and the second control valve 21 opened. As a result, the operating fluid L2 in the sub tank 26 is supplied into the second liquid chamber 6 through the second control valve 21, while the operating fluid L2 in the second liquid chamber 6 is supplied into the sub tank 26 through the first control valve 73. In other words, the operating fluid L2 is circulated between the sub tank 26 and the second liquid chamber 6 by operating the liquid feed pump 22. This circulating operation enables discharge of air included in the second liquid chamber 6, the communication pipe 24, and the supply pipe 23 into the sub tank 26.

As described earlier, in the ejection apparatus 10 shown in FIG. 1, the first liquid chamber 5 and the second liquid chamber 6 are separated by the two flexible films 1 and 2. If the film 1 and the film 2 are capable of being deformed independently of each other, then, an attempt may be made to adjust the liquid surface level inside the sub tank 26, but the pressure inside the ejection head 14 cannot be controlled. For example, an attempt to control the liquid surface inside the sub tank 26 to a level lower than the ejection openings 15 ends up with movement of only the film 2 in the +X direction shown in FIG. 2 until the internal pressure of the liquid chamber 6 becomes equal to the atmospheric pressure. As a result, the operating fluid L2 flows out in a large amount from the second liquid chamber 6 into the sub tank 26, and the operating fluid L2 overflows from the air intake pipe 25 in the sub tank 26. Alternatively, the portion of the operating fluid L2 returned into the sub tank 26 by the liquid surface adjustment function to adjust the liquid surface inside the sub tank 26 is sent into the main tank 34. In either case, the operating fluid in the second liquid chamber 6 will eventually disappear, and the film 2 will stick to the wall of the housing 12.

In the present embodiment, however, the film 1 and the film 2 move simultaneously such that the internal pressures of the first liquid chamber 5 and the second liquid chamber 6 are maintained to be equal. Thus, by controlling the pressure inside the second liquid chamber 6, the pressure inside the first liquid chamber 5 and the ejection openings 15, which communicate with the first liquid chamber 5, can be controlled to be the appropriate pressure. Specifically, by providing the hydraulic head difference ΔH between the liquid surface of the operating fluid L2 inside the sub tank 26 and the ejection openings 15, it is possible to form a meniscus 17 suitable for ejection in each ejection opening.

Here, air sometimes gets into the storage container 13 when the communication pipe 24 and the supply pipe 23 are coupled to the storage container 13. Also, air sometimes gets into the second liquid chamber 6 through small gaps formed in the joints between the storage container 13 and its pipes due to aging or the like. If air gets into the second liquid chamber 6 as described above and forms air bubbles inside the operating fluid L2, the pressure inside the first liquid chamber 5 cannot be properly controlled in some cases. For example, there is a case where air gets into the second liquid chamber 6, the internal pressure of the first liquid chamber 5 and the second liquid chamber 6 turns from negative pressure to positive pressure, thus causing the ejection material L1 to leak from the ejection openings 15.

Figure 4:
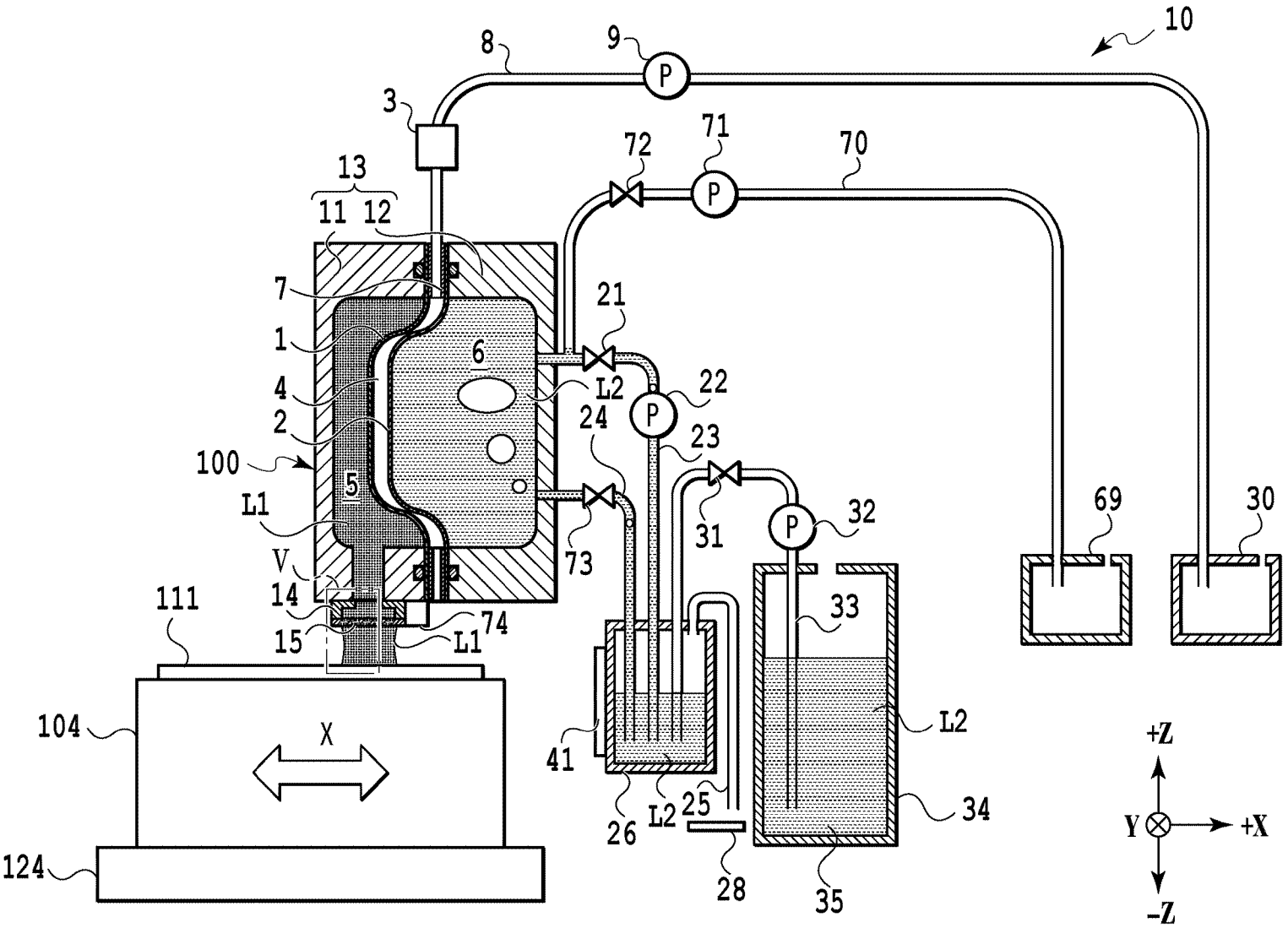
FIG. 4 is a diagram showing a state of the ejection apparatus in which an ejection material has leaked from the ejection head.

FIG. 4 is a diagram showing a state of the ejection apparatus 10 in the present embodiment in a case where a liquid has leaked from the ejection openings 15. As mentioned earlier, in a normal ejection operation, the hydraulic head difference ΔH between the ejection openings 15 and the sub tank 26 is controlled to be 40±4 mm in order to set the internal pressure of the first liquid chamber 5 at a value lower than the atmospheric pressure by 0.40±0.04 kPa.

However, in a case where air bubbles get into the communication pipe 24, the supply pipe 23, or the second liquid chamber 6, the meniscus 17 formed in each of the ejection openings 15 may collapse and the ejection material L1 may leak from the ejection openings 15 onto the substrate 111 as shown in FIG. 4.

To solve this, in the present embodiment, an image of the top of the substrate 111 is captured with the camera 74, which is provided next to the ejection head 14, to detect whether the ejection material L1 has leaked from the ejection openings 15 onto the substrate 111. Although an example using the camera 74 as a leakage detection unit to detect leakage of the ejection material L1 is presented here, it is possible to use another sensor to detect a state where the ejection material L1 has leaked. It is possible to detect leakage, for example, by using a leakage (liquid leakage) sensor provided at the surface of the ejection head 14 or by using a signal detection unit that detects counter electromotive force signals from the piezoelectric elements incorporated in the ejection head 14. Alternatively, leakage (liquid leakage) may be detected using a pressure sensor provided in the housing 12 or the like. The ejection apparatus 10 only needs to include one of the above leakage detection units.

A process executed in a case where leakage of the ejection material L1 is detected will be described below. In a case where a leakage detection sensor, such as the camera 74, detects leakage of the ejection material L1 (liquid leakage) from the ejection openings 15, a process of switching the first control valve 73 from an open state to a closed state and stopping the supply of the operating fluid L2 from the sub tank 26 into the second liquid chamber 6 is performed.

Thereafter, the second control valve 21 is switched from an open state to a closed state, the third control valve 72 is switched from a closed state to an open state, and the first discharge pump 71 is driven. The first discharge pump 71 sucks in the operating fluid L2 from the joint between the first discharge pipe 70 and the supply pipe 23 into the first waste liquid container 69 to control the internal pressure of the second liquid chamber 6. Specifically, the negative pressure is controlled to be a pressure lower than −0.40 kPa and higher than or equal to −3 kPa relative to the atmospheric pressure. The pressure lower than −0.40 kPa is a lower pressure (greater negative pressure) than the pressure (negative pressure) generated in the first and second liquid chambers 5 and 6 by the hydraulic head difference ΔH between the liquid surface inside the sub tank 26 and the ejection openings 15 in a normal ejection operation. In other words, the pressure lower than −0.40 kPa relative to the atmospheric pressure means a lower pressure (greater negative pressure) than the pressure (negative pressure) for forming and maintaining a meniscus 17 suitable for ejection in each ejection opening 15. Further, the pressure higher than or equal to −3 kPa relative to the atmospheric pressure means such a pressure that air is not taken in from the ejection openings 15.

Figure 5:
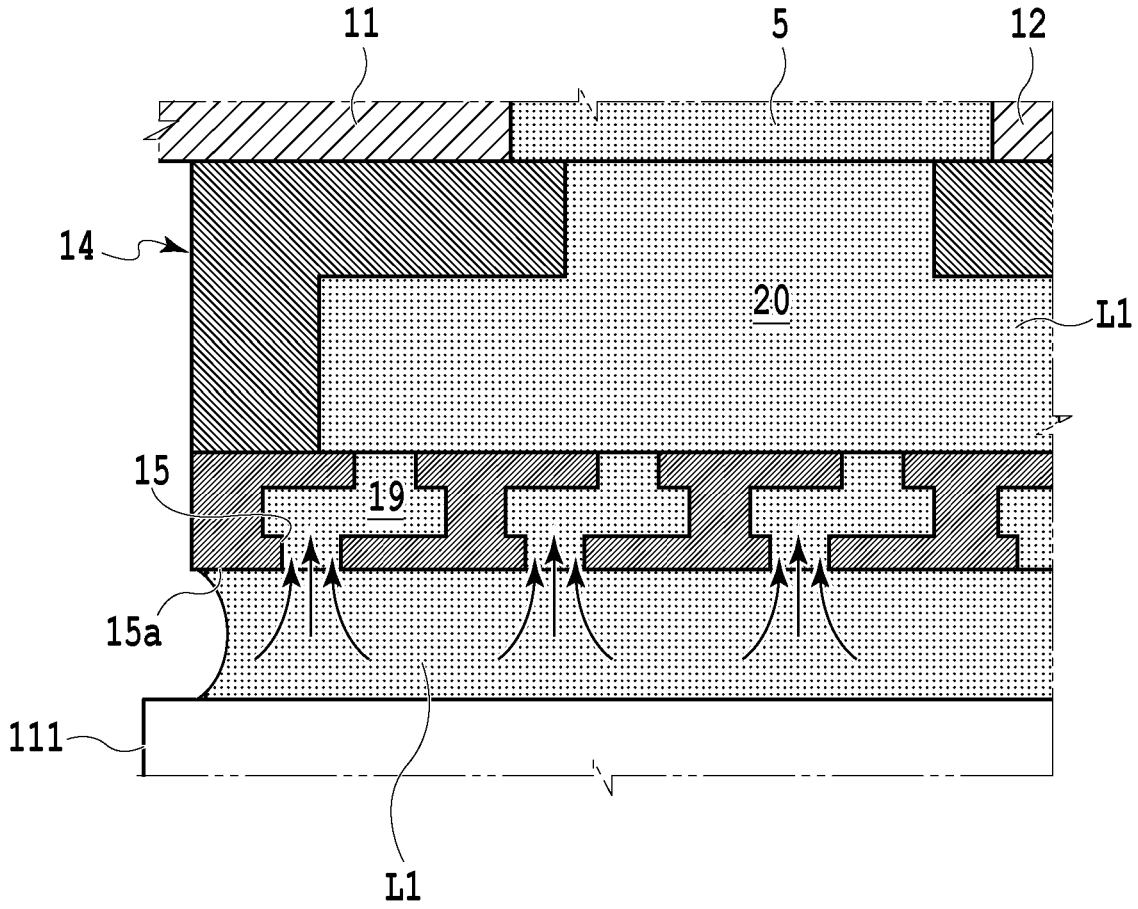
FIG. 5 is a schematic diagram showing a state of collecting the ejection material having leaked from the ejection head.

With the internal pressure of the first liquid chamber 5 controlled to be a pressure as above, the ejection material L1 having leaked (a liquid having leaked) onto the substrate 111 can be sucked in and collected from the ejection openings 15, as shown in FIG. 5. During the operation of collecting the ejection material L1, it is preferable to stop the movement of the ejection apparatus 10 and the substrate stage 104 so that the ejection material L1 having leaked onto the substrate 111 can be prevented from getting attached to unnecessary portions.

Here, an example has been presented in which the ejection head 14 is used as a suction unit to suck in and collect the ejection material L1 having leaked onto the substrate 111. Note, however, that suction nozzles (not shown) other than those in the ejection head 14 may be provided near the ejection head 14 and used to suck in and collect the ejection material L1. Further, in a case where leakage (liquid leakage) is detected, heat exhaust from a heat exhaust mechanism (not shown) provided around the ejection apparatus 10 is preferably switched to organic exhaust from an organic exhaust mechanism (not shown) provided around the ejection apparatus. In this manner, it is possible to prevent the odor caused by the leakage (liquid leakage) from spreading around and thus improve the work environment around the ejection apparatus 10.

After the ejection material L1 having leaked onto the substrate 111 is sucked in and collected from the ejection openings 15, a process of widening the distance between the ejection opening surface of the ejection head 14 and the substrate 111 is performed by moving the position of the ejection cartridge 100 vertically upward (+Z direction) with a raising-lowering mechanism not shown. By this process, the ejection material L1 remaining in the gap between the substrate 111 and the ejection opening surface of the ejection head 14 is prevented from wetting and spreading on the substrate 111 with capillary force. Note that a method in which the substrate stage 104 is moved vertically downward (−Z direction) can alternatively be employed as a method of widening the distance between the ejection opening surface of the ejection head 14 and the substrate 111 after the suction collection.

After the suction collection of the ejection material L1 having leaked onto a position facing the ejection head 14 is finished as described above, whether the ejection material L1 has leaked onto another region(s) on the substrate 111 is further detected with the leakage detection unit, such as the camera 74. Here, in a case where leakage of the ejection material L1 is detected, the ejection head 14 is moved to position the ejection openings 15 directly above the ejection material L1 that has leaked. This movement is done by moving the cartridge 100 relative to the substrate 111. Alternatively, the movement can be done by moving the substrate 111 along with the substrate stage 104.

Then, the substrate 111 and the ejection openings 15 are brought closer to each other. The distance between the substrate 111 and the ejection openings 15 is preferable 500 um or less. This makes it possible to suck in and collect the liquid having leaked onto the substrate 111.

Here, an example in which the camera 74 identifies regions where leakage (liquid leakage) has occurred has been described. Note, however, that the regions do not necessarily have to be identified. The ejection openings 15 may be moved over the entire surface of the substrate 111 to sequentially suck in and collect the ejection material L1 that has leaked. Alternatively, the camera 74 may be moved to a different position to observe the entire substrate 111, and then the ejection material L1 that has leaked may be collected.

Figure 6:
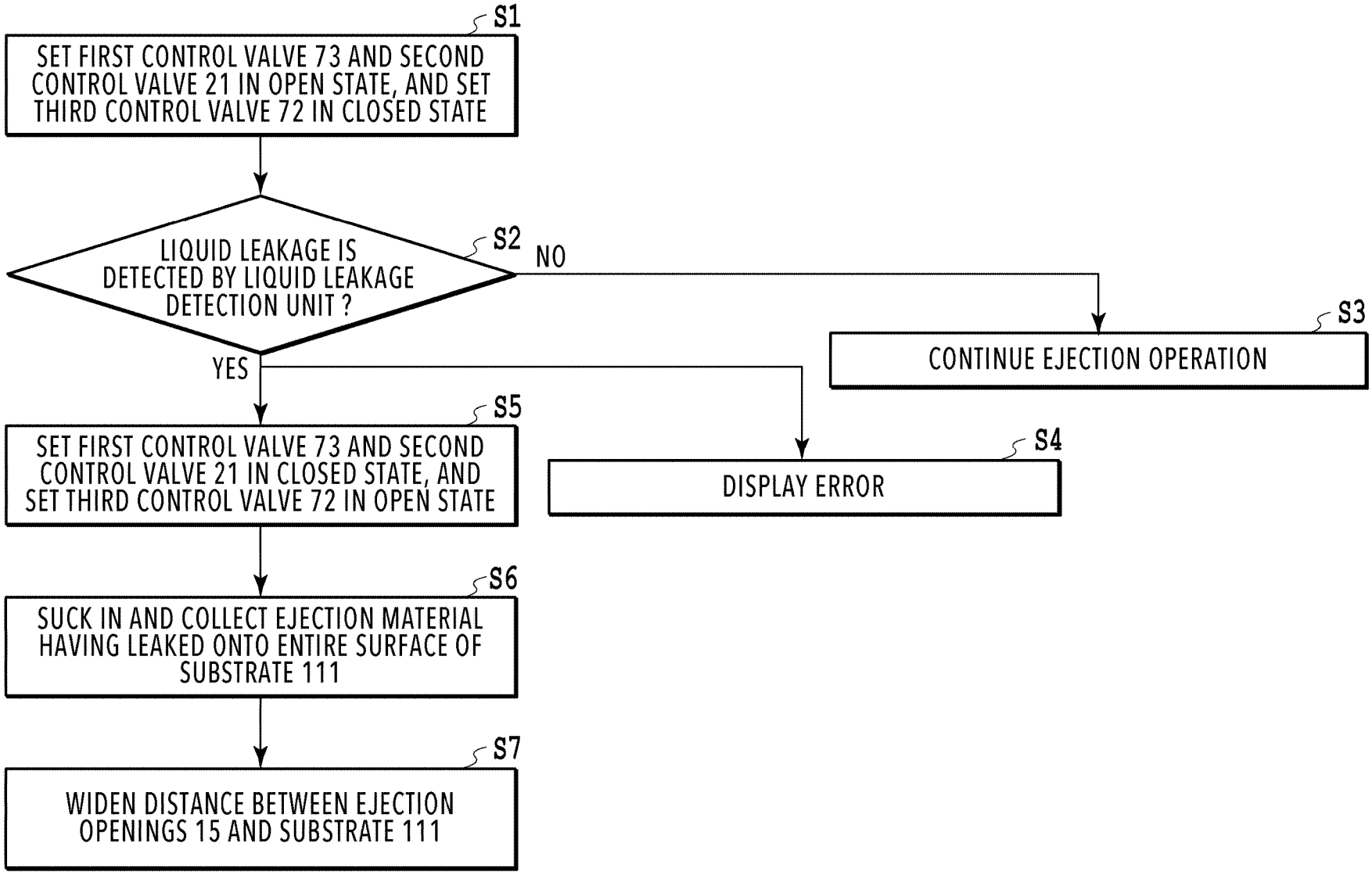
FIG. 6 is a flowchart showing a process of collecting the ejection material.

Next, a procedure of the operation of collecting the ejection material L1 executed by the control unit 16 of the ejection apparatus 10 will be described with reference to a flowchart shown in FIG. 6. Note that the symbol S attached to each step number in the flowchart means a step.

As described above, the ejection apparatus 10 in the present embodiment includes a function to eject the ejection material L1 and a function to collect the liquid that has leaked. In an operation of ejecting the ejection material L1, the first control valve 73 and the second control valve 21 are in an open state, and the third control valve 72 is in a closed state (S1). Also, during the operation of ejecting the ejection material L1, the leakage detection unit, such as the camera 74, detects whether the ejection material L1 leaks from the ejection opening 15 (S2). Here, if leakage of the ejection material L1 is not detected, the first and second control valves 73 and 21 are maintained in the open state and the third control valve 72 is maintained in the closed state, and the ejection operation is continued in this state (S3).

If leakage of the ejection material L1 is detected, an error is displayed on a display unit not shown provided to the imprint apparatus 101 (S4). Moreover, the first control valve 73 and the second control valve 21 are switched to a closed state and the third control valve 72 is switched to an open state (S5), so that the second liquid chamber 6 communicates with the first discharge pump 71.

The first discharge pump 71 is in a state of generating a negative pressure between the third control valve 72 and the first discharge pump 71 while the ejection apparatus 10 is driven. Thus, this negative pressure is applied to the second liquid chamber 6. The negative pressure, relative to the atmospheric pressure, applied by the first discharge pump 71 switches the first control valve 73 and the second control valve 21 from an open state to a closed state and switches the third control valve 72 from a closed state to an open state. As a result, the second liquid chamber 6 communicates with the first discharge pump 71. The pressure of the first discharge pump 71 is control to be a value less than −0.40 kPa and more than or equal to −3 kPa relative to the atmospheric pressure. With this negative pressure applied to the second liquid chamber 6, a similar negative pressure is generated in the first liquid chamber 5 as well. As a result, the ejection material L1 having leaked onto the substrate 111 is sucked in and collected from the ejection openings 15 by the negative pressure generated in the first liquid chamber 5.

After the ejection material L1 that has leaked is sucked in and collected, a process of moving the ejection openings 15 and the substrate 111 away from each other in the +Z direction is performed (S7). This is done by raising the cartridge 100 in the +Z direction (upward) with a position control mechanism (not shown) for the cartridge 100, or by lowering the substrate stage 104 in the −Z direction with a spring or the like not shown provided to the substrate stage 104. By moving the ejection openings 15 away from the substrate 111, the liquid remaining in the gap between the surface with the ejection openings 15 and the substrate 111 is prevented from wetting and spreading on the substrate 111 with capillary force.

Then, the leakage detection unit, such as the camera 74, captures an image of a region at another position on the substrate 111, and if leakage of the ejection material L1 is detected, the ejection openings 15 are moved to that position and suck in and collect the ejection material L1. These collection operations are sequentially executed to collect all the ejection material L1 that has leaked onto the substrate (S7).

As described above, according to the present embodiment, the ejection material L1 having leaked from the ejection openings 15 of the ejection head 14 can be sucked in and collected. Hence, it is possible to reduce contamination due to attachment of the leaking ejection material L1 to the substrate, the apparatus, and so on.

A description has been given of a configuration in which the negative pressure inside the storage container 13 is controlled to be the second pressure in a case where the ejection material L1 leaks from the ejection openings 15. Note, however, that the present invention is not limited to this configuration. Specifically, even if the ejection material L1 is not leaking from the ejection openings 15, the negative pressure may be raised and controlled to be the second pressure before the ejection material L1 leaks. This prevents leakage of the ejection material L1. Also, even if leakage of the ejection material is not actually detected, whether leakage of the ejection material could have been detected or whether the ejection material is about to leak may be determined based the pressure inside the storage container, and pressure control may be performed based on the result of this determination. In short, in a case where the pressure inside the storage container exceeds the first pressure and reaches a predetermined pressure, the pressure inside the storage container may be controlled to shift from the predetermined pressure to the second pressure.

Second Embodiment

Figure 7:
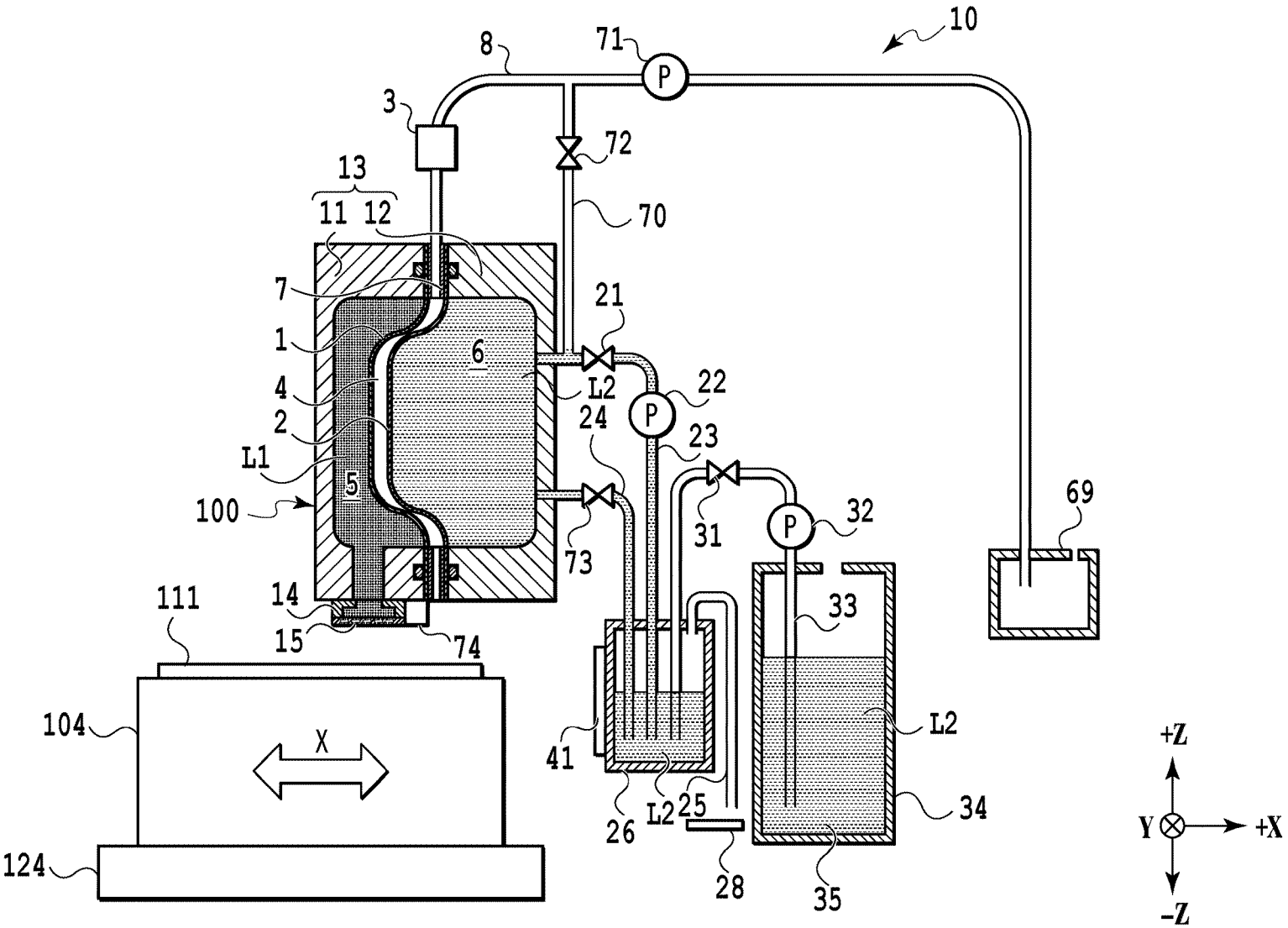
FIG. 7 is a diagram showing a configuration of an ejection apparatus in a second embodiment.

Next, a second embodiment will be described with reference to FIG. 7. An example in which the second discharge pump 9 and the second waste liquid container 30 are coupled to the second discharge pipe 8 has been presented in the first embodiment. Unlike this, in the second embodiment, the second discharge pipe 8 and the first discharge pipe 70 are merged, and the first discharge pump 71 is coupled to the merged channel. In this way, negative pressure can be generated in the first discharge pipe 70 and the second discharge pipe 8 by using only the first discharge pump 71. The discharge pump 71 is controlled to generate a pressure lower than −0.4 kPa and higher than or equal to −3 kPa. The other components are similar to those in the first embodiment. Employing the above configuration enables detection of leakage (liquid leakage) with the leakage sensor (liquid leakage sensor) and collection of the ejection material L1 having leaked from the ejection openings 15 by using only the first discharge pump 71. Accordingly, the ejection apparatus can be downsized.

Third Embodiment

Figure 8:
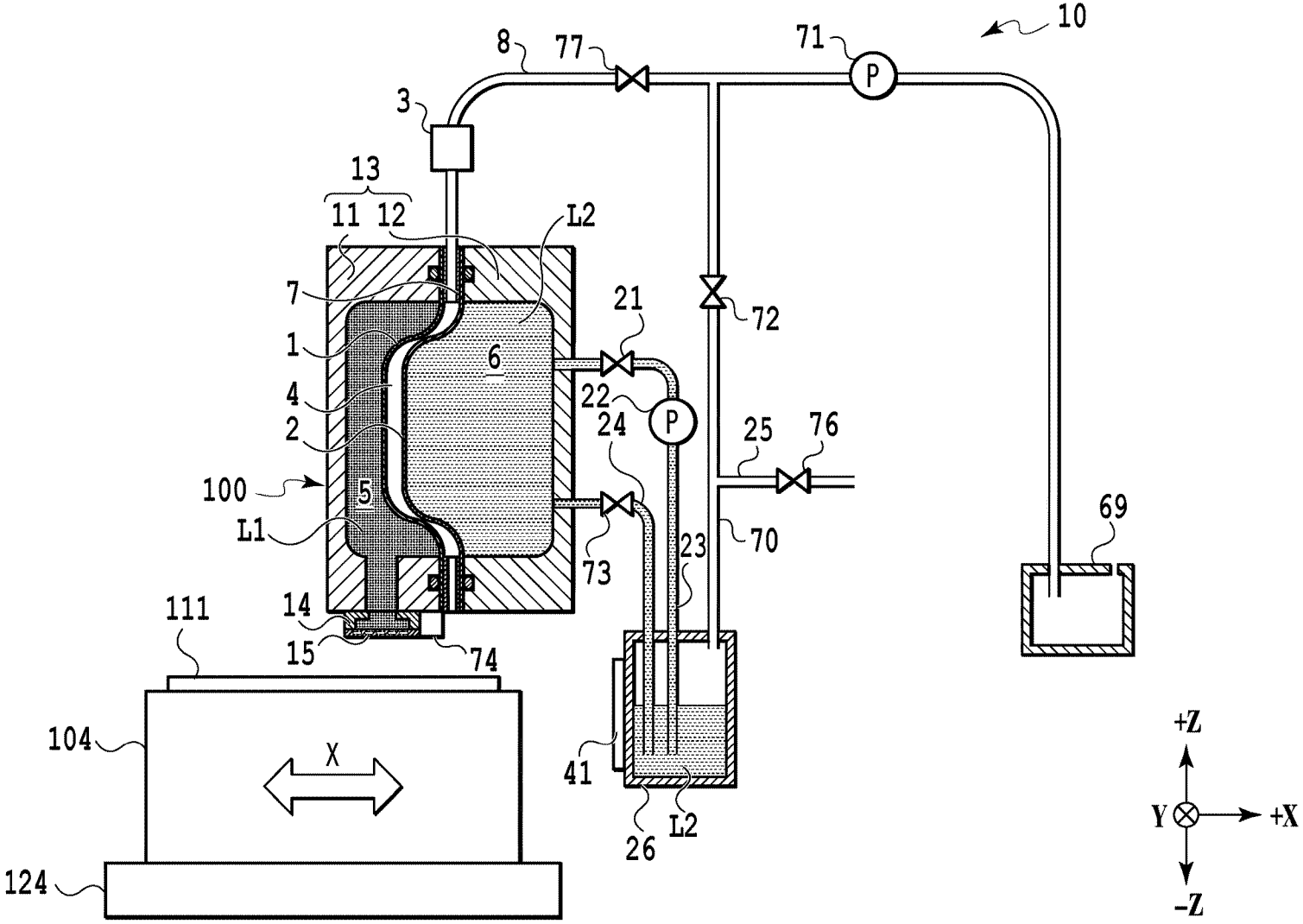
FIG. 8 is a diagram showing a configuration of an ejection apparatus in a third embodiment.

Next, a third embodiment will be described with reference to FIG. 8. In the above second embodiment, one end of the first discharge pipe 70 is coupled to an intermediate portion of the supply pipe 23, and the other end of the first discharge pipe 70 is coupled to the second discharge pipe 8 through the third control valve 72. Unlike this, in the third embodiment, one end of the first discharge pipe 70 is coupled to the sub tank (storage unit) 26, and the other end of the first discharge pipe 70 is coupled to the second discharge pipe 8. A control valve 77 is coupled to the second discharge pipe 8. Also, the third control valve 72 is coupled to an intermediate portion of the first discharge pipe 70. Further, the air intake pipe 25 is coupled to a portion of the first discharge pipe 70 between the sub tank 26 and the third control valve 72. The air intake pipe 25 communicates with the atmosphere through a fifth control valve 76. The other components are similar to those in the second embodiment.

In a case of a normal operation, in which leakage (liquid leakage) is not detected, the first control valve 73, the second control valve 21, and the fifth control valve 76 are set in an open state, and the third control valve 72 is set in a closed state. As a result, the sub tank 26 communicates with the atmosphere through the air intake pipe 25. Thus, in the normal operation, a negative pressure suitable for ejection of the ejection material L1 is generated inside the ejection head 14 by the hydraulic head difference between the liquid surface of the operating fluid L2 in the sub tank 26 and the meniscus 17 in each ejection opening 15.

Note that in the present embodiment, the first pressure control unit that generates a negative pressure (first pressure) in the storage container 13 for forming a meniscus suitable for ejection in each ejection opening 15 includes the sub tank 26, the communication pipe 24, the air intake pipe 25, and the fifth control valve (first valve) 76. Also, the second pressure control unit that generates a pressure (second pressure) lower than the first pressure in the storage container 13 includes the following constituent elements. Specifically, the second pressure control unit includes the first discharge pump (negative pressure generation unit) 71, the first discharge pipe 70, the third control valve (second valve) 72, the sub tank 26, and the communication pipe 24.

On the other hand, in a case where leakage of the ejection material L1 is detected, the second control valve 21 and the fifth control valve 76 are set in a closed state, and the first and third control valves 73 and 72 are set in an open state. As a result, the negative pressure generated by the first discharge pump (second pressure control unit) 71 (a negative pressure lower than −0.4 kPa and higher than or equal to −3 kPa), which is greater than the negative pressure in the normal ejection operation, is applied to the first and second liquid chambers 5 and 6 and the ejection openings 15. By this negative pressure, the ejection material L1 having leaked onto the substrate 111 is sucked in and collected from the ejection openings 15. Note that in the present embodiment, the first control valve 73 is constantly maintained in an open state. For this reason, the first control valve 73 can be omitted.

Fourth Embodiment

Next, a fourth embodiment will be described with reference to FIG. 9. The fourth embodiment involves a configuration assuming a state where the supply of electric power from a main electric power source to the ejection apparatus is shut off due to an electric power source abnormality, electricity failure, or the like. Generally, in a case where the supply of electric power from an electric power source is shut off, the control valves and the like for controlling the negative pressure inside the cartridge 100 cannot be properly operated. Sensors such as the leakage sensor (liquid leakage sensor) 3, the full-level sensor 28, and the liquid level sensor 41 do not operate either. Thus, it is difficult to figure out the state of pressure in the cartridge 100.

Normally, the internal pressure of the cartridge 100 is maintained to be a small negative pressure of around −0.4 kPa relative to the atmospheric pressure. For this reason, in the event of an electric power source abnormality or the like, there is a possibility that the internal pressure of the cartridge 100 (the internal pressures of the first and second liquid chambers 5 and 6) turns to positive pressure. If the internal pressure of the cartridge 100 turns to positive pressure, the ejection material L1 will leak from the ejection openings 15 and get attached to the substrate 111, the substrate stage 104, and the base surface plate 124, thereby contaminating the inside of the apparatus. Thus, it will take a long time to restore the apparatus.

To solve this, the ejection apparatus 10 in the present embodiment is configured to, in a case where an electricity failure or electric power source abnormality occurs, shift the internal pressure of the cartridge 100 to a pressure lower than the usual internal pressure (to a greater negative pressure) to thereby suppress leakage of the ejection material L1 from the ejection openings 15.

In the ejection apparatus 10 in the present embodiment, the following two types of solenoid valves are disposed in channels for controlling the internal pressure of the cartridge 100. Specifically, in the channels are disposed: a normally closed solenoid valve, which is in an open state while energized and is in a closed state while not energized; and a normally open solenoid valve, which is in a closed state while energized and is in an open state while not energized.

Figure 9:
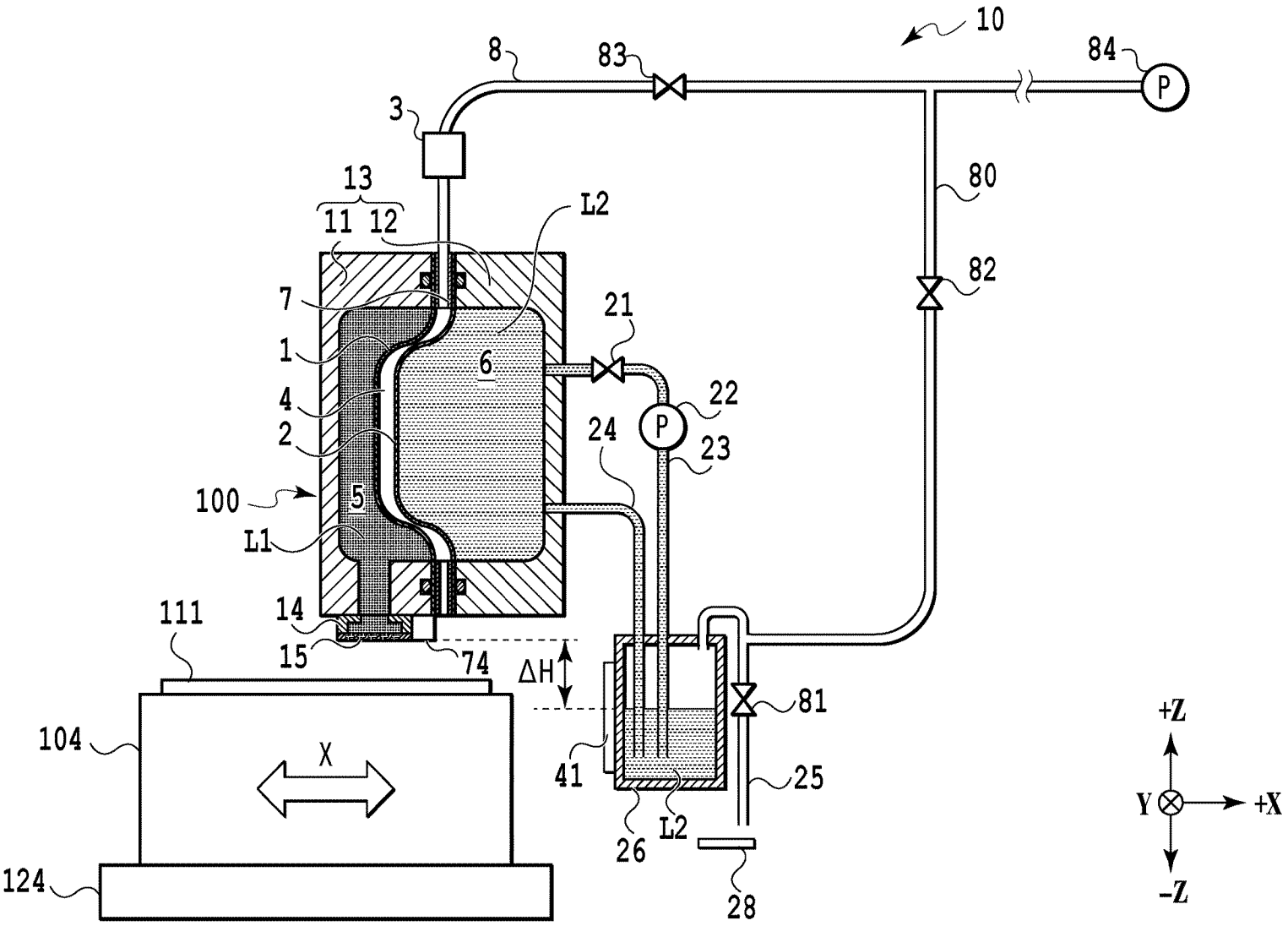
FIG. 9 is a diagram showing a configuration of an ejection apparatus in a fourth embodiment.

In FIG. 9, the sub tank (storage unit) 26 of the ejection apparatus 10 is provided with the air intake pipe 25, as in the first embodiment. The air intake pipe 25 is provided with a first valve 81 being a normally closed solenoid valve. Further, a pipe 80 is coupled to a portion of the air intake pipe 25 between the first valve 81 and the joint between the air intake pipe 25 and the sub tank 26. The pipe 80 is provided with a second valve 82 being a normally open solenoid valve. The discharge pipe 8 is provided with a third valve 83 being a normally closed solenoid valve.

The pipe 80 and the discharge pipe 8 communicate with a vacuum generation source 84. In an example, the vacuum generation source 84 is provided in a facility in which the ejection apparatus is installed, such as exhaust equipment. The electric power for the vacuum generation source 84 is supplied through a path different from that for the ejection apparatus 10 from an electric power supply apparatus (rechargeable battery or electric generator) provided in the facility. Note that the pressure of the vacuum generation source 84 is controlled to be lower than −0.4 kPa and higher than or equal to −3 kPa. The vacuum generation source 84 generates a pressure (second pressure) lower than the small negative pressure to be generated by the sub tank 26, i.e., the first pressure for forming a meniscus 17 at an appropriate position in each ejection opening 15.

Note that in the present embodiment, the first pressure control unit that generates the first pressure in the storage container 13 includes the sub tank 26, the communication pipe 24, and the first valve 81. Also, the second pressure control unit that generates the second pressure in the storage container 13 includes the pipe 80, the second valve 82, and the vacuum generation source 84.

In a normal operation, in which electric power is properly supplied to the ejection apparatus 10, the first valve 81 and the third valve 83 are in an open state, and the second valve 82 is in a closed state. Thus, the sub tank 26 communicates with the atmosphere through the first valve 81, which is in an open state, whereas communication between the sub tank 26 and the vacuum generation source 84 is blocked by the second valve 82. In this state, the internal pressure of the cartridge 100 is −0.40 kPa relative to the atmospheric pressure, and the small negative pressure state is being maintained. Also, since the second valve 82 is in a closed state and the third valve 83 is in an open state, the vacuum generation source 84 communicates with the inter-film space 4. As a result, the internal pressure of the inter-film space 4 is maintained at a negative pressure lower than −0.4 kPa and higher than or equal to −3 kPa.

In a case where an abnormality occurs in the electric power source of the ejection apparatus 10, the ejection apparatus 10 shifts to the following state. As the energization of the ejection apparatus 10 stops due to the abnormality of the electric power source, the second valve 82, which is a normally open solenoid valve, automatically switches to an open state, and the first valve 81 and the third valve 83, which are normally closed solenoid valves, automatically switch to a closed state. At this time, the communication between the sub tank 26 and the atmosphere is blocked by the first valve 81, which is in a closed state. Moreover, since the second valve 82 is in an open state and the third valve 83 is in a closed state, the sub tank 26 communicates with the vacuum generation source 84, so that the internal pressure of the cartridge 100 switches from the pressure in the normal operation (−0.40 kPa) to a pressure lower than −0.4 kPa and higher than or equal to −3 kPa. In short, the internal pressure switches to a lower pressure (greater negative pressure) than the pressure in the normal operation.

As described above, in the present embodiment, in a case where an abnormality occurs in the electric power source, the internal pressure of the cartridge 100 automatically switches from a small negative pressure to a further lower pressure (further greater negative pressure). This reduces the risk of leakage of the ejection material L1 from the ejection openings 15.

Note that although an example in which the first to third valves 81 to 83 are solenoid valves has been presented in the present embodiment, they may be replaced with other valves. In an example, capacitor-type valves that open and close according to accumulation of electricity in a capacitor can be used in the channels in the ejection apparatus 10, and a similar advantageous effect can be expected.

Also, the configuration in the present embodiment can be used to suck in and collect the ejection material L1 having leaked onto the substrate 111. Specifically, in a case where the camera 74 detects leakage of the liquid onto the substrate 111, the second valve is switched from a closed state to an open state, and the lower pressure is applied to the sub tank 26 by the vacuum generation source 84. In this way, the ejection material L1 having leaked onto the substrate 111 is sucked in and collected as in the above first to third embodiments.

Conversely, in the configurations of the above first to third embodiments, two types of solenoid valves as those in the present embodiment can be disposed as appropriate so as to automatically apply a lower pressure to the inside of the cartridge 100 in a case where an abnormality occurs in the electric power source or the like.

Further, although an example assuming the occurrence of an abnormality in the electric power source is presented in the present embodiment, the present disclosure is not limited to this example. It is possible to reduce the risk of leakage of the ejection material L1 from the ejection openings 15 in a state where the ejection apparatus 10 is not performing an ejection operation, e.g., a standby state where the ejection apparatus 10 is waiting to eject the ejection material L1.

Fifth Embodiment

Figure 10:
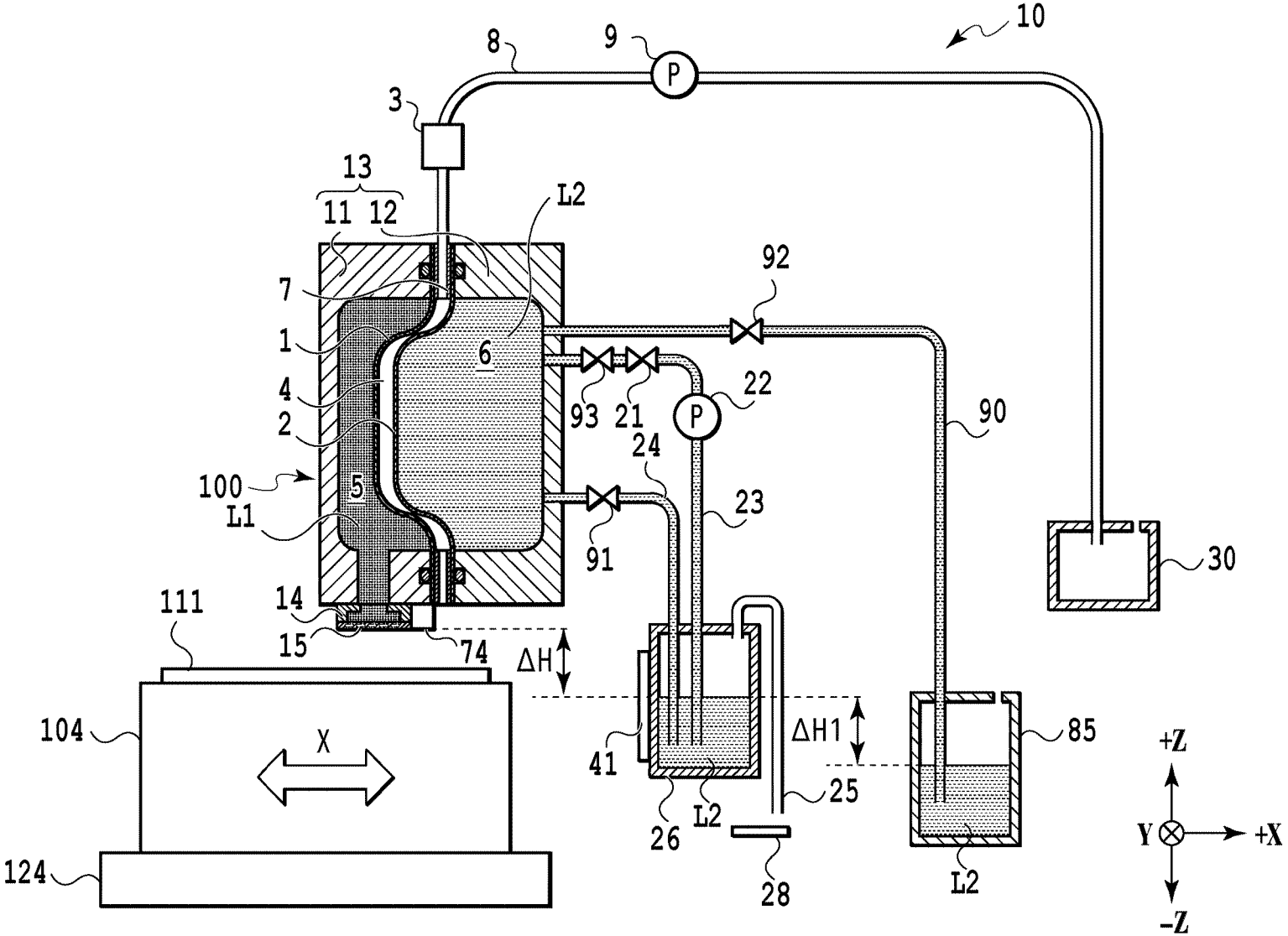
FIG. 10 is a diagram showing a configuration of an ejection apparatus in a fifth embodiment.

Next, a fifth embodiment will be described with reference to FIG. 10. In the following, the differences from the foregoing other embodiments will be mainly described. The present embodiment includes a second pressure control unit capable of applying, to the inside of the cartridge 100, a negative pressure greater than the negative pressure applied to the inside of the cartridge 100 by the sub tank (storage unit) 26. The second pressure control unit includes a coupling pipe 90, a second sub tank 85 coupled to the second liquid chamber 6 in the storage container 13 by the coupling pipe 90, and a second valve 92 provided at an intermediate portion of the coupling pipe 90. The operating fluid L2 is filled in the coupling pipe 90. The operating fluid L2 is stored in the second sub tank 85 up to a position higher in the vertical direction than the lower end of the coupling pipe 90. The second sub tank 85 communicates with the atmosphere.

The hydraulic head difference between the liquid surface of the operating fluid L2 in the second sub tank 85 and the liquid surface of the operating fluid L2 in the sub tank 26 is ΔH1, and the liquid surface of the operating fluid L2 in the second sub tank 85 is always located lower in the direction of gravity than the liquid surface of the operating fluid L2 in the sub tank 26. Thus, the hydraulic head difference between the liquid surface of the operating fluid L2 in the second the sub tank 26 and the ejection openings 15 is (ΔH+ΔH1). Accordingly, the second pressure control unit generates a greater negative pressure (lower pressure) than the negative pressure generated by the hydraulic head difference ΔH between the operating fluid L2 in the sub tank 26 and the ejection openings 15.

The communication pipe 24, which couples the sub tank 26 and the second liquid chamber 6, is provided with a first valve 91. Also, the supply pipe 23, which couples the sub tank 26 and the second liquid chamber 6, is provided with the liquid feed pump 22 and the second control valve 21, as in the other embodiments. Further, the supply pipe 23 is provided with a third valve 93 at a portion between the second control valve 21 and the second liquid chamber 6. Each of the first valve 91 and the third valve 93 is a normally closed solenoid valve, and the second valve 92 is a normally open solenoid valve.

In a normal operation, in which electric power is properly supplied to the ejection apparatus 10, the first valve 91 and the third valve 93 are in an open state, and the second valve 92 is in a closed state. In this state, the sub tank 26 communicates with the second liquid chamber 6 through the first valve 91 and the third valve 93, which are in an open state. Accordingly, the negative pressure generated by the hydraulic head difference ΔH between the liquid surface inside the sub tank 26 and the ejection openings 15 is applied to the inside of the cartridge 100. This negative pressure is a negative pressure of −0.40 kPa relative to the atmospheric pressure, as mentioned above, and thus the inside of the cartridge 100 is maintained at a small negative pressure.

Here, in a case where an abnormality occurs in the electric power source of the ejection apparatus 10, the energization of the first to third valves 91 to 93 stops. Thus, each of the first valve 91 and the third valve 93 automatically switches to a closed state. As a result, the communication between the sub tank 26 and the second liquid chamber 6 is blocked.

On the other hand, the second valve 92 switches to an open state, so that the second sub tank 85 communicates with the second liquid chamber 6. As a result, a greater negative pressure (lower pressure) than the negative pressure in the normal operation is applied to the inside of the cartridge 100 by the hydraulic head difference between the liquid surface inside the second sub tank 85 and the ejection openings 15. This reduces the risk of leakage of the ejection material L1 from the ejection openings 15.

Sixth Embodiment

Figure 11:
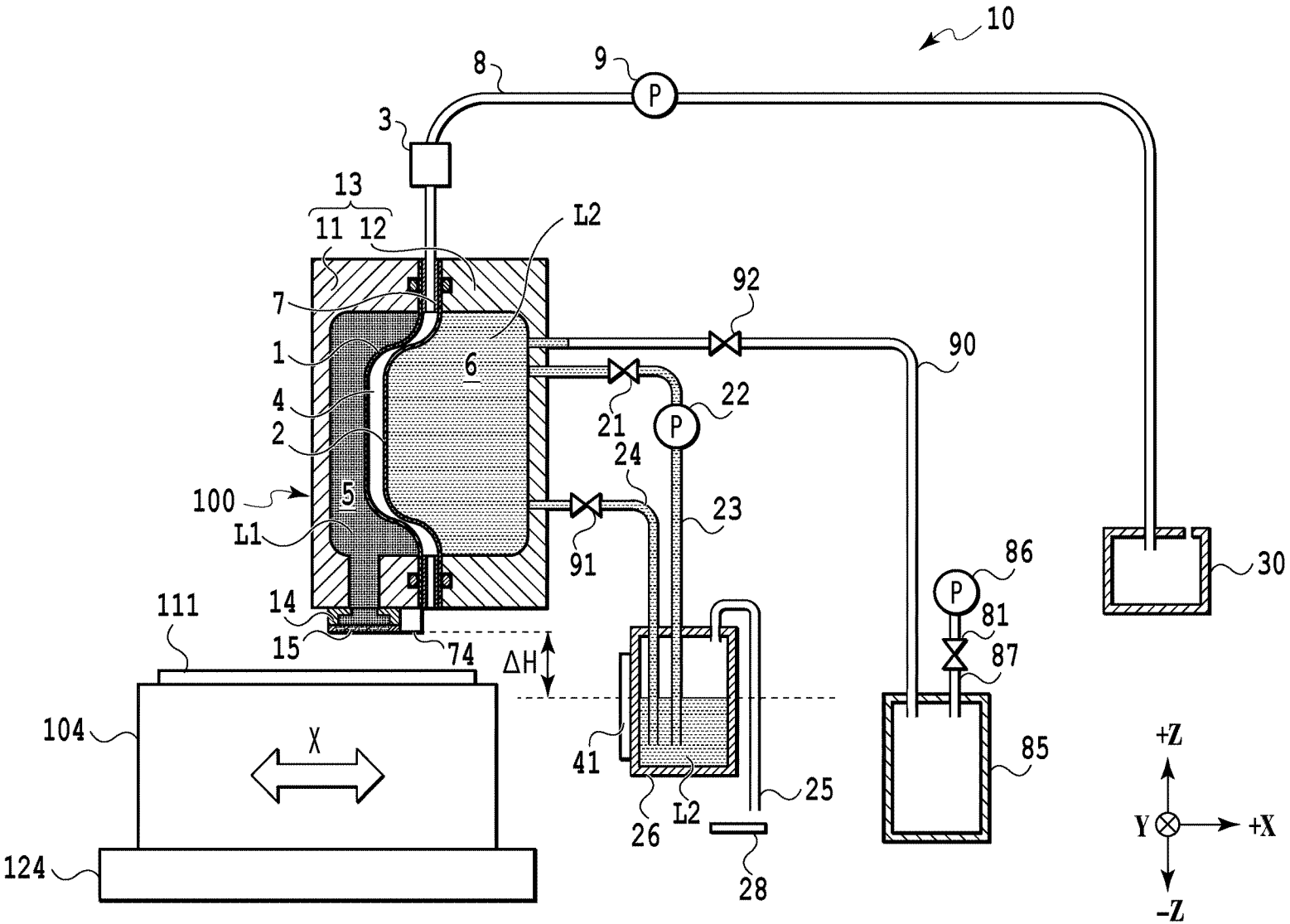
FIG. 11 is a diagram showing a configuration of an ejection apparatus in a sixth embodiment.

Next, a sixth embodiment will be described with reference to FIG. 11. The present embodiment has a configuration obtained by changing part of the above-described fifth embodiment. Thus, the same parts as those in the fifth embodiment are denoted by the same reference signs, and detailed description thereof is omitted. In the present embodiment, the first pressure control unit that generates a negative pressure (first pressure) in the storage container 13 for forming a meniscus suitable for ejection of the ejection material L1 in each ejection opening 15 includes the sub tank 26, the communication pipe 24, and the first valve 91. Also, the second pressure control unit that generates a pressure (second pressure) lower than the first pressure in the storage container 13 includes the following constituent elements. Specifically, the second pressure control unit includes the second sub tank (second storage unit) 85, the coupling pipe 90, the second control valve (second valve) 92, a second discharge pump (negative pressure generation unit) 86, a pump pipe 87, and a fourth valve 81.

Here, the second discharge pump 86 communicates with the second liquid chamber 6 in the storage container 13 through the coupling pipe 90. At an intermediate portion of the coupling pipe 90 is provided the second valve 92, which switches between enabling and blocking communication between the second sub tank 85 and the second liquid chamber 6. The second discharge pump 86 is capable of generating a pressure (second pressure) lower than the first pressure (−0.40 kPa) generated by using the sub tank 26.

Also, the second discharge pump 86 is coupled to the second sub tank 85 through the pump pipe 87. The fourth valve 81 is provided at an intermediate portion of the pump pipe 87. This fourth valve 81 switches between enabling and blocking communication between the second sub tank 85 and the second discharge pump 86.

The first valve 91, which is coupled to the communication pipe 24, the third valve 21, which is provided to the supply pipe 23, and the fourth valve 81 are normally closed solenoid valves. On the other hand, the second valve 92, which is provided to the coupling pipe 90, is a normally open solenoid valve.

In a normal operation, in which electric power is properly supplied to the ejection apparatus 10, the first valve 91, the third valve 21, and the fourth valve 81 are in an open state, and the second valve 92 is in a closed state. Thus, the sub tank 26 is in a state of communicating with the second liquid chamber 6 through the communication pipe 24 and the supply pipe 23. Accordingly, the negative pressure generated by the hydraulic head difference ΔH between the liquid surface inside the sub tank 26 and the ejection openings 15 is applied to the second liquid chamber 6. This negative pressure is −0.40 kPa, and thus the internal pressure of the storage container 13 is maintained at a small negative pressure. Also, in this state, the fourth valve 81 is in an open state and therefore the second sub tank 85 communicates with the second discharge pump 86. Thus, in the normal operation, the second discharge pump 86 maintains the internal pressure of the second sub tank 85 at a negative pressure equivalent to that of the discharge pump 86, i.e., a pressure (second pressure) lower than −0.40 kPa.

Here, in a case where an abnormality occurs in the electric power source of the ejection apparatus 10, the energization of the first to fourth valves 91 to 81 stops. Thus, each of the first valve 91, the third valve 21, and the fourth valve 81 automatically switch to a closed state. As a result, the communication between the sub tank 26 and the second liquid chamber 6 is blocked. The communication between the second discharge pump 86 and the second sub tank 85 is also blocked.

On the other hand, the second valve 92 automatically switches to an open state as a result of stopping being energized, so that the second sub tank 85 and the second liquid chamber 6 communicate with each other. Consequently, the negative pressure held in the second sub tank 85 by the second discharge pump 86 while the electric power source is in the normal state is applied to the storage container 13 through the coupling pipe 90. This negative pressure applied to the storage container 13 is a greater negative pressure (lower pressure) than the negative pressure generated in the storage container 13 in the normal operation by the hydraulic head difference between the liquid surface inside the sub tank 26 and the ejection openings 15. Hence, in the present embodiment too, the risk of leakage of the ejection material L1 from the ejection openings 15 due to an electric power source abnormality is reduced.

Seventh Embodiment

Figure 12:
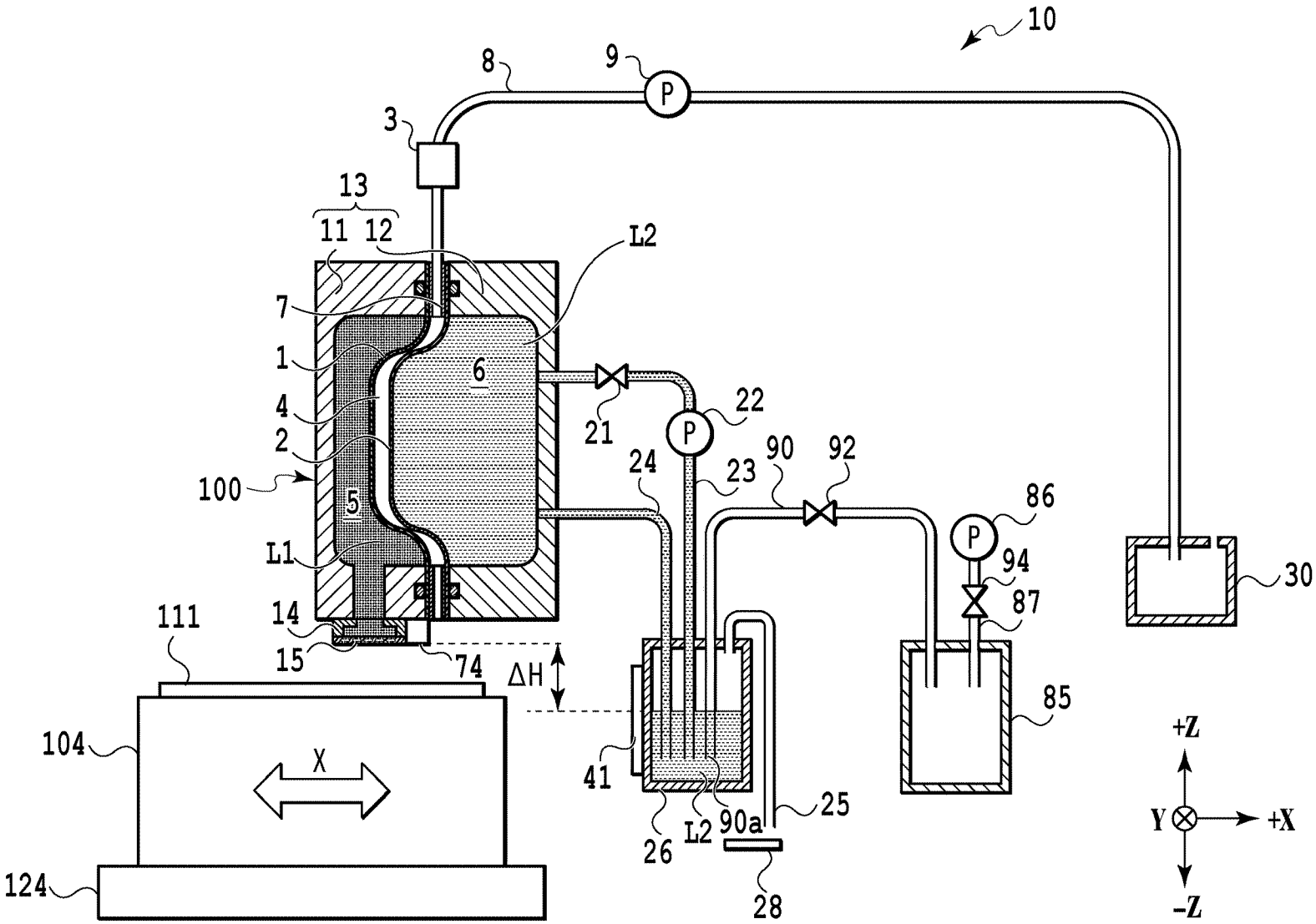
FIG. 12 is a diagram showing a configuration of an ejection apparatus in a seventh embodiment.

Next, a seventh embodiment will be described with reference to FIG. 12. The present embodiment has a configuration obtained by changing part of the above-described sixth embodiment. Thus, the same parts as those in the sixth embodiment are denoted by the same reference signs, and detailed description thereof is omitted. In the present embodiment too, a second pressure control unit is included which is capable of applying, to the inside of the cartridge 100, a negative pressure (second pressure) greater than the negative pressure (first pressure) generated in the cartridge 100 by using the sub tank (storage unit) 26. In the present embodiment, however, the coupling pipe 90, which is coupled to the second sub tank 85, has its one end 90*a* coupled not to the second liquid chamber 6 but to the inside of the sub tank 26. The one end 90*a* of the coupling pipe 90 is inserted in the operating fluid L2 stored in the sub tank 26 so deeply that the one end 90*a* of the coupling pipe 90 will not be separated from the operating fluid L2 in the sub tank 26 by a change in the liquid level of the operating fluid L2 in the sub tank 26.

Also, the first valve 91 provided to the communication pipe 24 in the sixth embodiment is omitted in the present embodiment, and the sub tank 26 and the second liquid chamber 6 are constantly in a state of communicating with each other through the communication pipe 24.

In the present embodiment, the first pressure control unit that generates a negative pressure (first pressure) in the storage container 13 for forming a meniscus suitable for ejection of the ejection material L1 in each ejection opening 15 includes the sub tank 26 and the communication pipe 24. Also, the second pressure control unit that generates a pressure (second pressure) lower than the first pressure in the storage container 13 includes the following constituent elements. Specifically, the second pressure control unit includes the second sub tank 85, the coupling pipe 90, the second control valve (second valve) 92, the second discharge pump (negative pressure generation unit) 86, the pump pipe 87, a fourth valve 94, the sub tank 26, and the communication pipe 24.

In a normal operation, in which electric power is properly supplied to the ejection apparatus 10, the second valve 92 is in a closed state, and the fourth valve 94 is in an open state. The sub tank 26 is in a state of communicating with the second liquid chamber 6 through the communication pipe 24, so that the internal pressure of the cartridge 100 is maintained at a small negative pressure (−0.40 kPa) by the hydraulic head difference ΔH between the liquid surface inside the sub tank 26 and the ejection openings 15. Also, since the fourth valve 94 is in an open state, the internal pressure of the second sub tank 85 is maintained at a lower pressure (greater negative pressure) than −0.40 kPa by the discharge pump 86.

In a case where an abnormality occurs in the electric power source of the ejection apparatus 10, the energization of the second valve 92 and the fourth valve 94 stops. Thus, the second valve 92 automatically switches to an open state, and the fourth valve 94 automatically switches to a closed state. As a result, the communication between the second discharge pump 86 and the second sub tank 85 is blocked. Thus, even if the second discharge pump 86 stops due to the abnormality of the electric power source, the internal pressure of the second sub tank 85 is maintained at a negative pressure similar to that in the normal operation since the communication between the second discharge pump 86 and the second sub tank 85 is blocked.

The sub tank 26 and the second sub tank 85, on the other hand, communicate with each other through the second valve 92, which has switched to an open state, so that the negative pressure in the normal operation maintained in the second sub tank 85 is applied to the sub tank 26. As a result, the internal pressure of the sub tank 26 and the cartridge 100, which communicates with the sub tank 26, becomes a greater negative pressure (lower pressure) than the negative pressure in the normal operation. Accordingly, the risk of leakage of the ejection material L1 from the ejection openings 15 is reduced.

Eighth Embodiment

Figure 13:
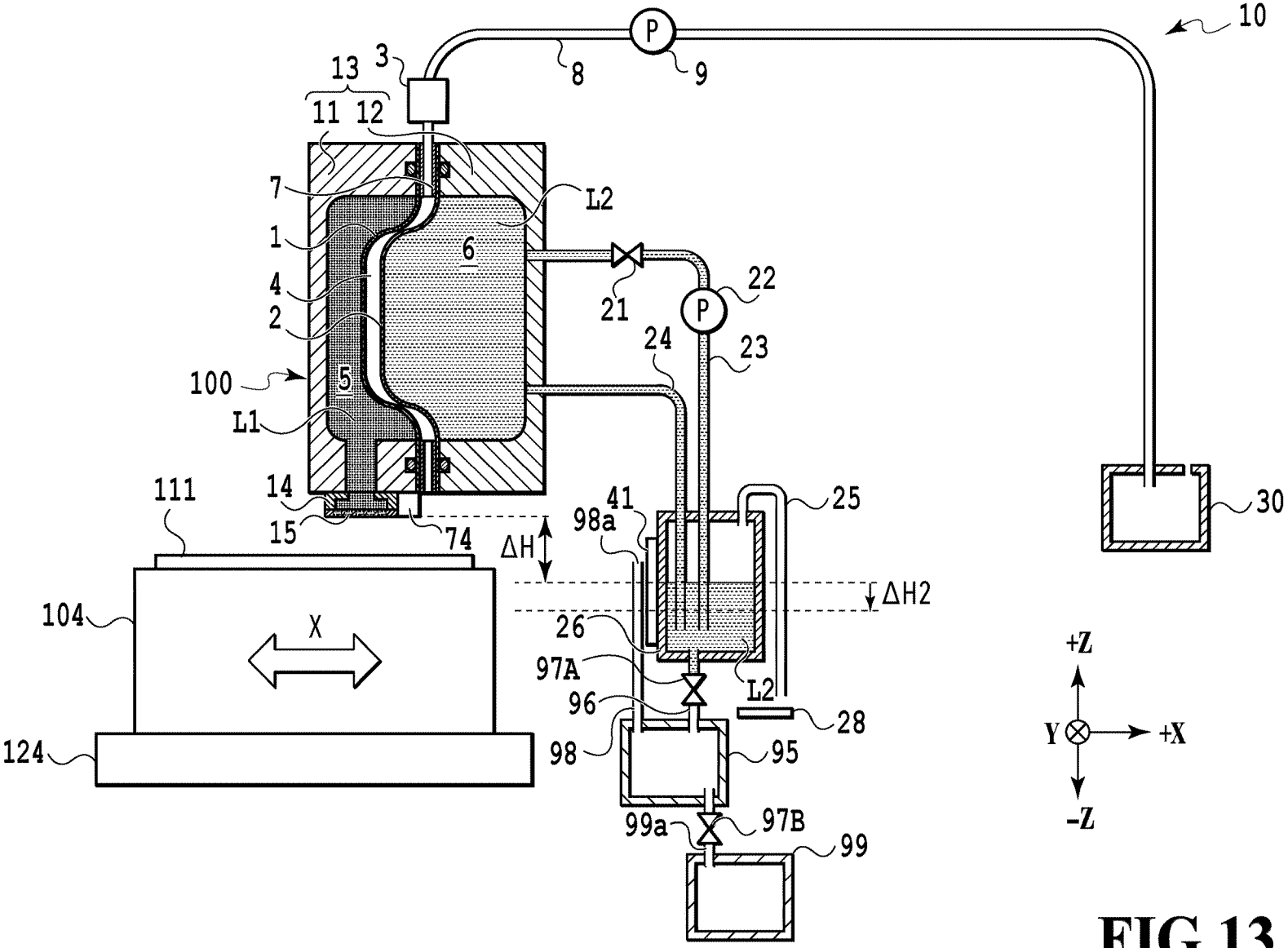
FIG. 13 is a diagram showing a configuration of an ejection apparatus in an eighth embodiment.

Next, an eighth embodiment will be described with reference to FIG. 13. Note that the same parts as those in the foregoing embodiments are denoted by the same reference signs, and detailed description thereof is omitted. In each of the foregoing embodiments, an example has been presented in which the drive force of a pump or the like is used to generate a negative pressure greater than the negative pressure generated in the cartridge 100 in a normal operation. Unlike this, the ejection apparatus 10 in the present embodiment is configured such that, in a case where an abnormality occurs in the electric power source, the operating fluid L2 in the sub tank (storage unit) 26 is moved to a second sub tank 95 disposed below the sub tank 26 to thereby maintain the internal pressure of the cartridge 100 at a pressure lower than that in the normal operation.

A more specific description will now be given. The second sub tank (second storage unit) 95 is provided vertically below the sub tank 26. The top of the second sub tank 95 is coupled to the bottom of the sub tank 26 through a pipe 96. A second valve 97A being a normally open solenoid valve is provided at an intermediate portion of the pipe 96. An air passage pipe 98 is provided at the top of the second sub tank 95. The air passage pipe 98 extends to vertically above the liquid surface of the operating fluid L2 stored in the sub tank 26, and an atmosphere communication opening 98*a* is formed at the tip of the air passage pipe 98.

A liquid discharge unit 99 is provided vertically below the second sub tank 95. The top of the liquid discharge unit 99 is coupled to the bottom of the second sub tank 95 through a liquid discharge pipe 99*a*. A first valve 97B being a normally closed solenoid valve is provided at an intermediate portion of the liquid discharge pipe 99*a*.

As described above, in the present embodiment, the first pressure control unit that generates a negative pressure (first pressure) in the storage container 13 for forming a meniscus suitable for ejection of the ejection material L1 in each ejection opening 15 includes the sub tank 26 and the communication pipe 24. Also, the second pressure control unit that generates a pressure (second pressure) lower than the first pressure in the storage container 13 includes the following constituent elements. Specifically, the second pressure control unit includes the second sub tank 95, the pipe 96, the second valve 97A, the sub tank 26, and the communication pipe 24.

In a normal operation, in which electric power is properly supplied to the ejection apparatus 10, the second valve 97A is in a closed state, and the first valve 97B is in an open state. Thus, the communication between the sub tank 26 and the second sub tank 95 is blocked, and the second liquid chamber 6 and the liquid discharge unit 99 communicate with each other. In this state, the negative pressure (−0.40 kPa) generated by the hydraulic head difference ΔH between the liquid surface of the operating fluid L2 in the sub tank 26 and the ejection openings 15 is applied to the cartridge 100, and thus the internal pressure of the sub tank 26 is maintained at a small negative pressure.

Here, in a case where an abnormality occurs in the electric power source of the ejection apparatus 10, the energization of the first valve 97B and the second valve 97A stops. Thus, the first valve 97B automatically switches to a closed state, and the second valve 97A automatically switches to an open state. As a result, the operating fluid L2 stored in the sub tank 26 flows into the second sub tank 95. Since the first valve 97B is in a closed state, the operating fluid L2 flowing into the second sub tank 95 is stored in the second sub tank 95.

The operating fluid L2 having flowed into the second sub tank 95 enters the air passage pipe 98. The liquid surface inside the sub tank 26 and the liquid surface inside the air passage pipe 98 eventually stop at the same level. The level (vertical position) of the liquid surface of the operating fluid L2 in this state is lower than the position of the liquid surface of the operating fluid L2 stored in the sub tank 26 in the normal operation. Specifically, there is a hydraulic head difference ΔH2 generated between the liquid surface inside the sub tank 26 in the normal operation and the liquid surface inside the sub tank 26 in a state where the electric power source has an abnormality. The internal pressure of the cartridge 100 drops (the negative pressure increases) by an amount corresponding to this hydraulic head difference ΔH2. The increase in the negative pressure inside the cartridge 100 suppresses leakage of the ejection material L1 from the ejection openings 15 even in the situation where the energization has stopped. Meanwhile, in a case where the electric power source of the ejection apparatus 10 is restored, the second valve 97A switches to a closed state and the first valve 97B switches to an open state, so that the operating fluid L2 stored in the second sub tank 95 is discharged into the liquid discharge unit 99 and discarded.

From the first embodiment, configurations have been described in which a first pressure is generated inside a storage container by a first pressure control unit, and then a second pressure lower than the first pressure is generated inside the storage container by a second pressure control unit. In the present disclosure, the configuration may be such that the first pressure is generated inside the storage container, and the pressure inside the storage container is controlled to drop to at least the first pressure in a case where the pressure inside the storage container rises (the negative pressure decreases) above the first pressure. Specifically, assuming that the internal pressure of the storage container in the state of having exceeded the first pressure is a predetermined pressure (third pressure), the internal pressure is controlled to be the first pressure and then from the predetermined pressure (third pressure) back to the first pressure. Such a configuration can also suppress contamination by the ejection material leaking from the ejection openings of the ejection head. Also, the internal pressure only needs to be dropped to at least the first pressure, and does not need to be finally stopped at the first pressure. The internal pressure may be controlled to be a pressure lower than the first pressure (e.g., the second pressure). In other words, as described in the foregoing embodiments, the pressure may be controlled to be the first pressure and then from a predetermined pressure (third pressure) back to the first pressure and then to the second pressure.

Other Embodiments

In each of the foregoing embodiments, an example has been presented in which the internal space of the storage container provided in the ejection apparatus is divided into a first liquid chamber and a second liquid chamber by a flexible partition. However, the present disclosure is applicable also to configurations in which the internal space of the storage container is divided into three or more liquid chambers or configurations in which the internal space of the storage container is not divided. For example, the present disclosure is also applicable to an ejection apparatus that ejects, from the ejection head, the ejection material stored in a storage container whose internal space is not divided.

Also, in each of the foregoing embodiments, the ejection apparatus 10 provided in the imprint apparatus 101 has been presented. However, the ejection apparatus according to the present disclosure is usable also in apparatuses other than imprint apparatuses. For example, the present disclosure is also applicable to an apparatus that forms a wiring pattern on a substrate by ejecting a liquid containing an electrically conductive material from an ejection head. Further, the present disclosure is also applicable to a drawing apparatus that draws an image by using an ultraviolet curable liquid for image printing, a liquid containing a solvent and a colorant for image printing (ink), or the like as an ejection material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-099327 filed May 28, 2019, and No. 2020-028557 filed Feb. 21, 2020, which are hereby incorporated by reference wherein in their entirety.

What is claimed is:

1. An ejection apparatus comprising:

an ejection head having an ejection opening for ejecting an ejection material in a liquid state;

a storage container storing therein the ejection material and communicating with the ejection head; and a pressure control unit that maintains pressure inside the storage container at a negative pressure, wherein the pressure control unit generates a first pressure in the storage container in a normal operation, the first pressure being capable of forming a meniscus of the ejection material in the ejection opening, and wherein the pressure control unit drops the pressure inside the storage container to at least the first pressure in a case where the pressure inside the storage container reaches a predetermined pressure above the first pressure.

2. The ejection apparatus according to claim 1, wherein the pressure control unit drops the pressure inside the storage container to at least the first pressure in a case where the pressure inside the storage container reaches the predetermined pressure and an abnormality being leakage of the ejection material from the ejection opening occurs.

3. The ejection apparatus according to claim 2, wherein the pressure control unit comprises:

a first pressure control unit that generates the first pressure in the storage container in the normal operation; and a second pressure control unit that generates a second pressure lower than the first pressure in the storage container in a case where the abnormality occurs, and wherein the pressure control unit drops the pressure inside the storage container to the second pressure in the case where the pressure inside the storage container reaches the predetermined pressure.

4. The ejection apparatus according to claim 3, further comprising a suction unit that sucks in and collects, with the second pressure, the ejection material having leaked onto an ejection target object onto which the ejection material is to be ejected.

5. The ejection apparatus according to claim 3, wherein the first pressure control unit includes a storage unit communicating with an atmosphere and coupled to the storage container, and a first valve that blocks communication between the storage unit and the storage container in a case where the pressure inside the storage container reaches the predetermined pressure, and wherein the first pressure control unit generates the first pressure in the storage container with a hydraulic head difference between a liquid surface of a liquid stored in the storage unit and the ejection opening, the hydraulic head difference being obtained by causing the first valve to enable communication between the storage unit and the storage container.

6. The ejection apparatus according to claim 5, wherein the second pressure control unit includes a negative pressure generation unit that generates the second pressure, and a second valve that switches between enabling and blocking communication between the negative pressure generation unit and the storage container communicate, and wherein in a case where communication between the storage unit and the storage container is blocked, the second valve enables communication between the negative pressure generation unit and the storage unit to thereby generate the second pressure, which is lower than the first pressure, in the storage container.

7. The ejection apparatus according to claim 6, wherein the second pressure control unit has a second storage unit communicating with the atmosphere and coupled to the storage container, and a second valve that switches between enabling and blocking communication between the second storage unit and the storage container, wherein in a case where the first valve enables communication between the storage unit and the storage container, the second valve blocks communication between the second storage unit and the storage container, and wherein in a case where the first valve blocks the communication between the storage unit and the storage container, the second valve enables the communication between the second storage unit and the storage container to thereby generate the second pressure in the storage container with a hydraulic head difference between a liquid surface of a liquid stored in the second storage unit and the ejection opening.

8. The ejection apparatus according to claim 6, wherein the second pressure control unit has a second storage unit coupled to the storage container, a second valve provided between the second storage unit and the storage container, and a negative pressure generation unit that generates the second pressure in the second storage unit, wherein in a case where the first valve enables communication between the storage unit and the storage container, the second valve blocks communication between the second storage unit and the storage container, and wherein in a case where the first valve blocks the communication between the storage unit and the storage container, the second valve enables the communication between the second storage unit and the storage container to thereby apply the second pressure generated in the second storage unit by the negative pressure generation unit to the storage container.

9. The ejection apparatus according to claim 6, wherein the second pressure control unit has a second storage unit coupled to the storage unit, a second valve provided between the second storage unit and the storage unit, and a negative pressure generation unit that generates the second pressure in the second storage unit, wherein in a case where the first valve enables communication between the storage unit and the storage container, the second valve blocks communication between the second storage unit and the storage unit, and wherein in a case where the first valve blocks the communication between the storage unit and the storage container, the second valve enables the communication between the second storage unit and the storage unit to thereby apply the second pressure generated in the second storage unit by the negative pressure generation unit to the storage unit and thus generate the second pressure in the storage container.

10. The ejection apparatus according to claim 4, wherein the suction unit moves relative to the ejection target object and sucks in the ejection material having leaked onto the ejection target object.

11. The ejection apparatus according to claim 4, wherein the suction unit is the ejection head, and wherein the ejection head sucks in the ejection material having leaked onto the ejection target object, from the ejection opening with the second pressure applied to an inside of the storage container.

12. The ejection apparatus according to claim 4, further comprising a mechanism that widens a distance between the suction unit and the ejection target object after the suction unit sucks in the ejection material having leaked onto the ejection target object.

13. The ejection apparatus according to claim 1, further comprising a leakage detection unit that detects the ejection material having leaked from the ejection opening onto an ejection target object, wherein the pressure inside the storage container is dropped to at least the first pressure based on a result of the detection by the leakage detection unit.

14. The ejection apparatus according to claim 13, wherein the leakage detection unit identifies a position of the ejection material having leaked onto the ejection target object from the ejection opening, and wherein a suction unit that sucks in and collects the ejection material having leaked onto the ejection target object moves to a position facing the position identified by the leakage detection unit and sucks in the ejection material with a second pressure lower than the first pressure.

15. The ejection apparatus according to claim 13, wherein the leakage detection unit is at least one of a leakage sensor, a camera, a signal detection unit that detects a counter electromotive force signal from a piezoelectric element incorporated in the ejection head, and a pressure sensor provided in the ejection apparatus.

16. The ejection apparatus according to claim 1, wherein the pressure control unit drops the pressure inside the storage container to at least the first pressure in a case where an abnormality of an electric power source occurs.

17. An imprint apparatus comprising:

an ejection apparatus; and a mold that forms a pattern, wherein the ejection apparatus includes an ejection head having an ejection opening for ejecting an ejection material in a liquid state, a storage container storing therein the ejection material and communicating with the ejection head, and a pressure control unit that maintains pressure inside the storage container at a negative pressure, wherein the pressure control unit generates a first pressure in the storage container in a normal operation, the first pressure being capable of forming a meniscus of the ejection material in the ejection opening, wherein the pressure control unit drops the pressure inside the storage container to at least the first pressure in a case where the pressure inside the storage container reaches a predetermined pressure above the first pressure, and wherein the mold is pressed against the ejection material ejected onto an ejection target object by the ejection apparatus, and the ejection material is cured to thereby form a pattern in the ejection material.

18. The imprint apparatus according to claim 17, wherein the ejection material is a resist for use in an imprint process.

* * * * *